US008596070B2

(12) United States Patent
Yoshida et al.

(10) Patent No.: US 8,596,070 B2
(45) **Date of Patent: *Dec. 3, 2013**

(54) COMBUSTOR COMPRISING A MEMBER INCLUDING A PLURALITY OF AIR CHANNELS AND FUEL NOZZLES FOR SUPPLYING FUEL INTO SAID CHANNELS

(75) Inventors: Shouhei Yoshida, Hitachiohta (JP); Yoshitaka Hirata, Tokai (JP); Hiroshi Inoue, Mito (JP); Tomoya Murota, Hitachinaka (JP); Toshifumi Sasao, Mito (JP); Nariyoshi Kobayashi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 906 days.

This patent is subject to a terminal disclaimer.

(21) Appl. No.: 12/571,805

(22) Filed: Oct. 1, 2009

(65) Prior Publication Data

US 2010/0170248 A1 Jul. 8, 2010

Related U.S. Application Data

(63) Continuation of application No. 11/241,989, filed on Oct. 4, 2005, now Pat. No. 7,610,759.

(30) Foreign Application Priority Data

Oct. 6, 2004 (JP) ..... 2004-293182

(51) Int. Cl.
*F02C 1/00* (2006.01)
*F02G 3/00* (2006.01)

(52) U.S. Cl.
USPC ..... 60/737; 60/746; 60/740

(58) Field of Classification Search
USPC ..... 60/737, 748, 746, 747, 740, 742
See application file for complete search history.

(56) References Cited

U.S. PATENT DOCUMENTS 5,417,070 A 5/1995 Richardson
5,450,725 A 9/1995 Takahara et al.

(Continued)

FOREIGN PATENT DOCUMENTS

EP 0762057 3/1997
EP 1201995 5/2002

(Continued)

OTHER PUBLICATIONS

Notification of Reasons for Refusal in Japanese Application No. 2004-293182, dispatched Jul. 20, 2010 (with English translation).

(Continued)

*Primary Examiner* — William H Rodriguez
(74) *Attorney, Agent, or Firm* — Brundidge & Stanger, P.C.

(57) ABSTRACT

A combustor and a combustion method for the combustor, which can suppress backfire and ensure stable combustion. The combustor comprises a mixing-chamber forming member for forming therein a mixing chamber in which air for combustion and fuel are mixed with each other, and a combustion chamber for burning a gas mixture mixed in the mixing chamber and producing combustion gases. A channel for supplying the air for combustion to the mixing chamber from the outer peripheral side of the mixing-chamber forming member is provided inside the mixing-chamber forming member. The fuel and the air are premixed in the channel, and a resulting premixed gas mixture is supplied to the mixing chamber.

15 Claims, 11 Drawing Sheets

(56) References Cited

U.S. PATENT DOCUMENTS

| | | | | |
|---|---|---|---|---|
| 5,664,412 | A | 9/1997 | Overton | |
| 5,761,906 | A | 6/1998 | Norster | |
| 6,834,505 | B2 | 12/2004 | Al-Roub et al. | |
| 6,901,760 | B2 | 6/2005 | Dittmann et al. | |
| 6,928,822 | B2 | 8/2005 | Rock | |
| 6,928,823 | B2 * | 8/2005 | Inoue et al. | 60/776 |
| 6,981,358 | B2 | 1/2006 | Bellucci et al. | |
| 7,313,919 | B2 * | 1/2008 | Inoue et al. | 60/737 |
| 7,426,833 | B2 | 9/2008 | Yoshida et al. | |
| 7,571,609 | B2 * | 8/2009 | Yoshida et al. | 60/737 |
| 7,571,612 | B2 * | 8/2009 | Yoshida et al. | 60/772 |
| 7,581,379 | B2 * | 9/2009 | Yoshida et al. | 60/39.463 |
| 7,673,455 | B2 * | 3/2010 | Yoshida et al. | 60/737 |
| 8,104,284 | B2 * | 1/2012 | Miura et al. | 60/746 |
| 8,117,846 | B2 * | 2/2012 | Wilbraham | 60/748 |
| 8,302,404 | B2 * | 11/2012 | Nilsson et al. | 60/748 |
| 8,316,644 | B2 * | 11/2012 | Wilbraham | 60/748 |
| 2002/0162333 | A1 | 11/2002 | Zelina | |
| 2003/0074885 | A1 | 4/2003 | Rokke | |
| 2003/0152880 | A1 | 8/2003 | Eroglu et al. | |
| 2003/0167771 | A1 | 9/2003 | Hayashi et al. | |
| 2004/0025508 | A1 | 2/2004 | Calvez et al. | |
| 2004/0068973 | A1 | 4/2004 | Wakabayashi et al. | |
| 2004/0123597 | A1 | 7/2004 | Kraft et al. | |
| 2008/0268387 | A1 * | 10/2008 | Saito et al. | 431/8 |
| 2009/0293484 | A1 * | 12/2009 | Inoue et al. | 60/740 |

FOREIGN PATENT DOCUMENTS

| | | |
|---|---|---|
| EP | 1489358 | 12/2004 |
| JP | 57-74521 | 5/1982 |
| JP | 4-148113 | 5/1992 |
| JP | 8-233270 | 9/1996 |
| JP | 2003-262337 | 9/2003 |
| JP | 2004- 507701 | 3/2004 |
| WO | 02/090831 | 11/2002 |

OTHER PUBLICATIONS

European Search Report in European Application No. 10185167.3-2301 mailed Dec. 27, 2010.

Notification of Reasons for Refusal in Japanese Application No. 2004-293182 dispatched Dec. 27, 2009.

* cited by examiner

COMBUSTOR COMPRISING A MEMBER INCLUDING A PLURALITY OF AIR CHANNELS AND FUEL NOZZLES FOR SUPPLYING FUEL INTO SAID CHANNELS

CROSS REFERENCE TO APPLICATION

The present application claims priority from Japanese Patent Application No. 2004-293182, filed Oct. 6, 2004 and is a continuation of application Ser. No. 11/241,989, filed Oct. 4, 2005 now U.S. Pat. No. 7,610,759; the contents of which are incorporated herein by reference.

BACKGROUND OF THE INVENTION

1. Field of the Invention

The present invention relates to a combustor and a combustion method for the combustor.

2. Description of the Related Art

Known combustor structures are disclosed in, e.g., JP,A 2004-507701 and US 2003/0152880A1. These Patent Documents disclose a double conical burner provided with a fuel supply member on an outer surface of a swirler.

SUMMARY OF THE INVENTION

In that related art, backfire and flame stability are not taken into consideration.

Accordingly, it is an object of the present invention to provide a combustor and a combustion method for the combustor, which can suppress backfire and ensure stable combustion.

To achieve the above object, the combustor according to the present invention comprises a mixing-chamber forming member for forming therein a mixing chamber in which air for combustion and fuel are mixed with each other; and a combustion chamber for burning a gas mixture mixed in the mixing chamber and producing combustion gases, wherein a channel for supplying the air for combustion to the mixing chamber from the outer peripheral side of the mixing-chamber forming member is provided inside the mixing-chamber forming member.

Thus, according to the present invention, a combustor and a combustion method for the combustor are provided which can suppress backfire and ensure stable combustion.

DESCRIPTION OF THE PREFERRED EMBODIMENTS

According to the present invention, a combustor includes a mixing-chamber forming member for forming therein a mixing chamber in which air for combustion and fuel are mixed with each other, and a channel for supplying the air for combustion to the mixing chamber from the outer peripheral side of the mixing-chamber forming member is provided inside the mixing-chamber forming member.

Embodiments of a combustor and a combustion method for the combustor according to the present invention will be described below with reference to the drawings.

(First Embodiment)

A first embodiment of the present invention will be described with reference to FIGS. 1 through 5.

Figure 1:
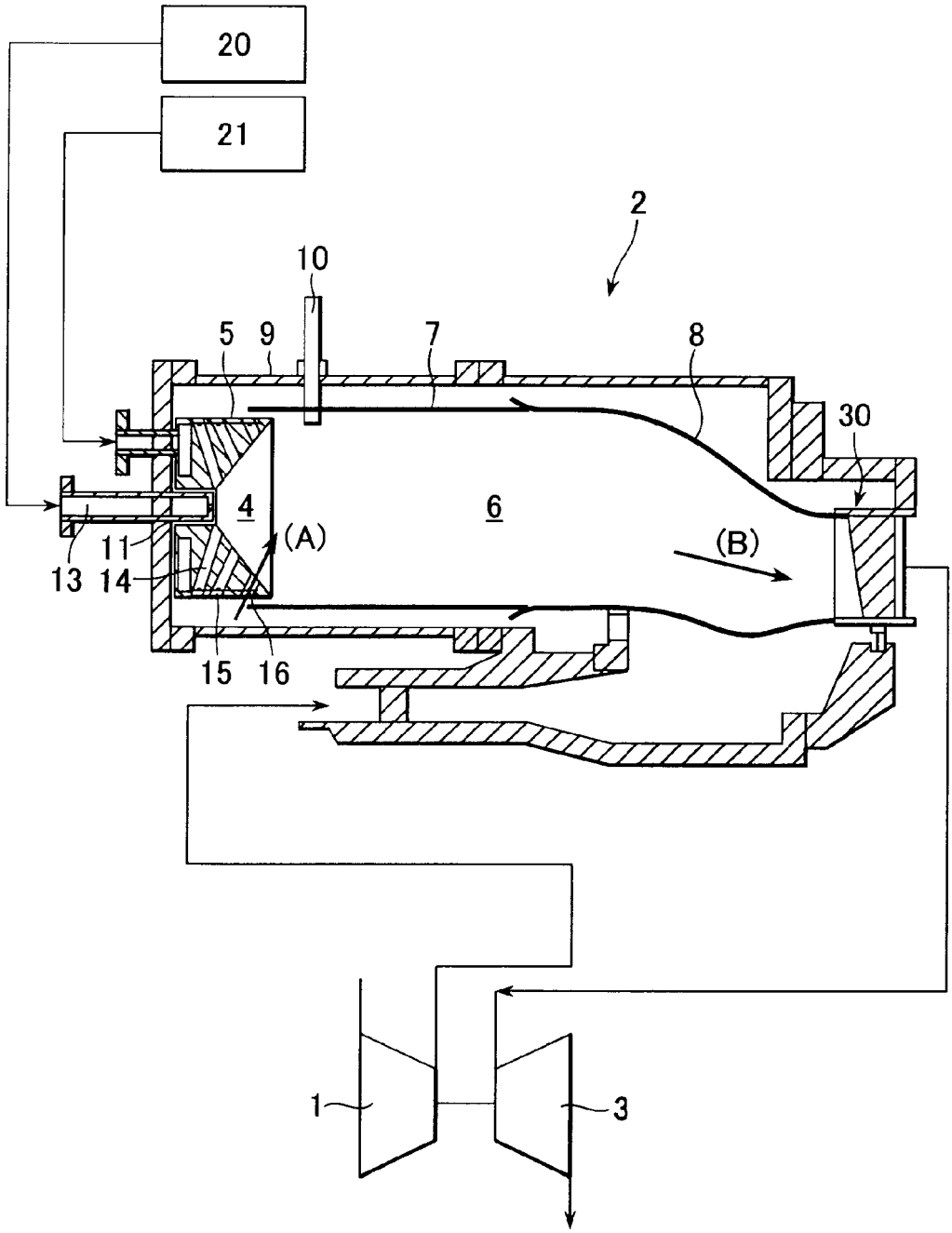
FIG. 1 shows an overall construction of a gas turbine plant according to a first embodiment of the present invention.

FIG. 1 shows an overall construction of a gas turbine plant according to the first embodiment of the present invention. In particular, FIG. 1 shows, as a side sectional view, a structure of a gas turbine combustor in the plant. As shown in FIG. 1, the gas turbine plant primarily comprises a compressor 1 for compressing air and producing high-pressure air for combustion, a combustor 2 for mixing the compressed air introduced from the compressor 1 and fuel with each other and producing combustion gases with burning of a gas mixture, and a gas turbine 3 to which are introduced the combustion gases produced by the combustor 2. The compressor 1 and the gas turbine 3 are mechanically coupled to each other.

The combustor 2 comprises a burner 11 including a mixing chamber 4 in which the fuel is mixed to the air for combustion and a mixing chamber wall 5 which serves as a mixing-chamber forming member to form the mixing chamber 4 therein, a combustion chamber 6 for burning the gas mixture mixed in the mixing chamber 4 and producing the combustion gases, an inner casing 7 for forming the combustion chamber 6 therein, a transition piece 8 for introducing the combustion gases from the inner casing 7 to the gas turbine 3, an outer casing 9 housing the burner 11, the inner casing 7 and the transition piece 8 therein, and an ignition plug 10 supported by the outer casing 9 and igniting the gas mixture in the combustion chamber 6. With that structure, the compressed air from the compressor 1 is introduced into the mixing chamber 4, as indicated by an arrow (A) in FIG. 1, and is mixed with the fuel. The gas mixture is ignited by the ignition plug 10 and burnt in the combustion chamber 6. The combustion gases produced with the burning of the gas mixture are injected into the gas turbine 3 through the transition piece 8, as indicated by an arrow (B) in FIG. 1, thereby driving the gas turbine 3. As a result, a generator (not shown) mechanically coupled to the gas turbine 3 is driven to generate electric power.

Figure 2:
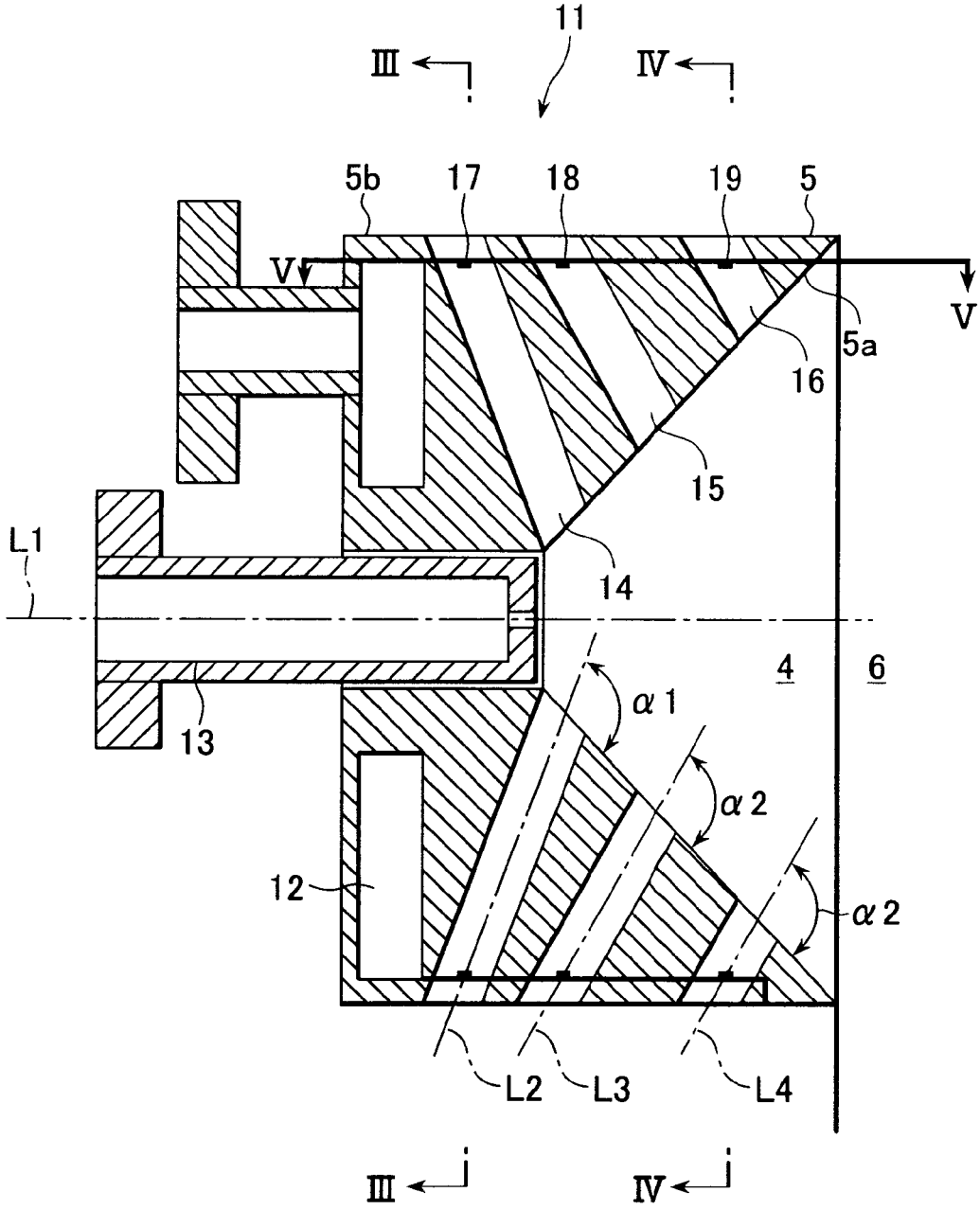
FIG. 2 is a sectional view showing a burner structure of a combustor according to the first embodiment of the present invention.

FIG. 2 is a side sectional view showing a detailed structure of the burner 11. As shown in FIG. 2, an inner wall surface 5*a* of the mixing-chamber forming member for forming the mixing chamber 4 therein has a diffuser-like shape or a hollow conical shape gradually spreading toward the combustion chamber 6 (to the right as viewed in FIG. 2, namely in the ejecting direction of a first fuel nozzle 13 described below). The first fuel nozzle 13 for ejecting first fuel to a position upstream of the combustion chamber 6 is disposed nearly an apex of the conical-shaped mixing-chamber inner wall surface 5*a* such that the first fuel nozzle 13 is substantially coaxial with an axis L1 of the mixing chamber wall 5. Also, the mixing chamber 4 has an outer wall surface 5*b* in a cylindrical shape. Air inlet holes 14, 15 and 16 for introducing the air for combustion from the compressor 1 are bored in the mixing chamber wall 5 in plural stages (three stages in this embodiment) in the direction of the axis L1 (hereinafter referred to as the "axial direction") and in plural points in the circumferential direction per stage such that those air inlet holes 14, 15 and 16 are arranged successively in this order from the upstream side in the axial direction (i.e., from the left side as viewed in FIG. 2). In other words, channels defined by the air inlet holes 14, 15 and 16, etc. are formed inside the mixing-chamber forming member.

Fuel holes 17, 18 and 19 are formed to be communicated with the air inlet holes 14, 15 and 16, respectively, for ejecting second fuel through respective wall surfaces forming the air inlet holes 14, 15 and 16. More specifically, the fuel holes 17, 18 and 19 are bored to be opened at respective inner wall surfaces of the air inlet holes 14, 15 and 16 near the mixing-chamber outer wall surface 5*b*, and also opened to a fuel manifold 12 for the second fuel, which is provided upstream of the mixing chamber 4. The second fuel can be ejected in a direction substantially perpendicular to respective axes L2, L3 and L4 of the air inlet holes 14, 15 and 16. Thus, the second fuel is supplied substantially at a right angle relative to the airflow.

The first fuel is supplied to the first fuel nozzle 13 through a first fuel supply line 20, and the second fuel is supplied to the fuel holes 17, 18 and 19 through a second fuel supply line 21 (see FIG. 1). The first fuel and the second fuel may be the same kind of gaseous fuel or liquid fuel. For example, they may be gaseous fuels differing in heating value. Alternatively, the first fuel and the second fuel may be respectively liquid fuel and gaseous fuel. Further, depending on the operation of the gas turbine, other various cases are also optional including, e.g., the case where only liquid fuel is supplied to the first fuel nozzle 13, the case where only gaseous fuel is supplied to the fuel holes 17, 18 and 19, or the case where liquid fuel is supplied to the first fuel nozzle 13 and gaseous fuel is supplied to the fuel holes 17, 18 and 19 at the same time.

In this first embodiment, a description is made of the manners for operating the gas turbine when only liquid fuel is supplied to the first fuel nozzle 13 and when only gaseous fuel is supplied to the fuel holes 17, 18 and 19.

The air inlet holes 14, 15 and 16 are formed such that angles at which the air for combustion is introduced to the mixing chamber 4 through the respective air inlet holes 14, and 16 are changed gradually at least relative to the circumferential direction of the mixing chamber wall 5. More specifically, in the upstream side of the mixing chamber 4, the plurality of air inlet holes 14 are each arranged so as to eject a jet flow of the air for combustion or a jet flow of a mixture of the gaseous liquid and the air for combustion toward a point near the position where the liquid fuel is ejected from the first fuel nozzle 13. Then, as an axial position approaches the downstream side of the mixing chamber 4, the air inlet holes 15 and 16 are arranged so as to eject jet flows of the air for combustion or jet flows of a mixture of the gaseous liquid and the air for combustion to advance closer to an inner circumferential surface of the mixing chamber wall 5, i.e., the mixing-chamber inner wall surface 5*a*. That arrangement will be described in more detail below with reference to FIGS. 3 and 4, as well as FIG. 2.

Figure 3:
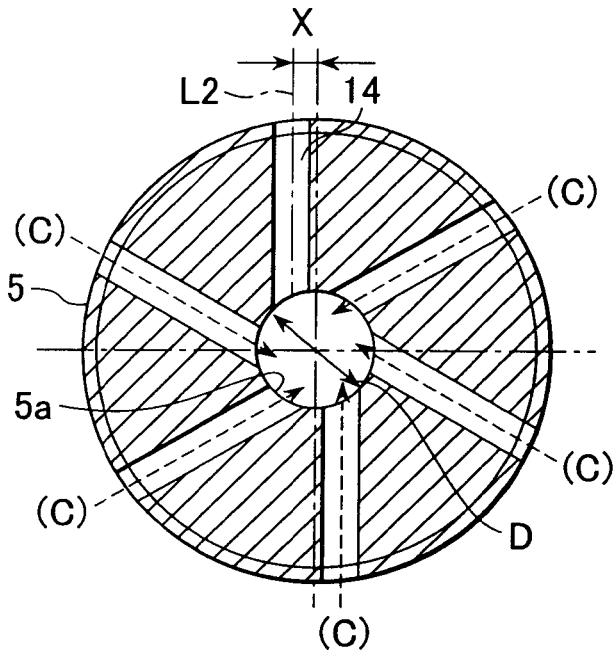
FIG. 3 is a sectional view (taken along the line III-III in FIG. 2) showing air inlet holes 14 serving as channels in the first embodiment of the present invention.
Figure 4:
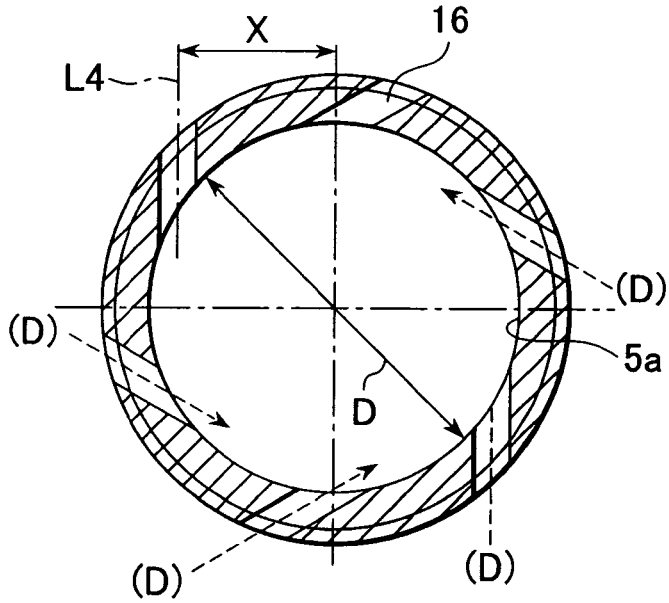
FIG. 4 is a sectional view (taken along the line IV-IV in FIG. 2) showing air inlet holes 16 serving as channels in the first embodiment of the present invention.

FIG. 3 is a side sectional view (taken along the line III-III in FIG. 2) of the mixing chamber wall 5 at an axial position where the air inlet holes 14 are bored. FIG. 4 is a side sectional view (taken along the line IV-IV in FIG. 2) of the mixing chamber wall 5 at an axial position where the air inlet holes 16 are bored.

Referring to FIGS. 3 and 4, X represents the offset distance between the axis L2, L4 of the air inlet hole 14, 16 and the axis L1 of the mixing chamber wall 5 (i.e., the length of a segment connecting the axis L1 and the axis L2, L4 in perpendicular relation), and D represents the inner diameter of the mixing chamber wall 5 at each axial position where the air inlet hole 14, 16 is bored. In this embodiment, the angles of the air inlet holes 14, 15 and 16 relative to the circumferential direction are changed such that X/D increases as a position approaches the downstream side in the axial direction of the mixing chamber wall 5 (to the right as viewed in FIG. 2). Thus, X/D takes a smaller value at the upstream position in the mixing chamber 4. Therefore, the air for combustion ejected from each air inlet hole 14 flows in toward the vicinity of the axis L1 of the mixing chamber wall 5 (i.e., the vicinity of the position where the liquid fuel is ejected from the first fuel nozzle 13), as indicated by an arrow (C) in FIG. 3. On the other hand, X/D takes a larger value at the downstream position in the mixing chamber 4. Therefore, the air for combustion ejected from each air inlet hole 16 flows in more closely to the inner circumferential surface of the mixing chamber wall 5, i.e., the mixing-chamber inner wall surface 5*a*, as indicated by an arrow (D) in FIG. 4.

Further, in this embodiment, angles at which the air inlet holes 14, 15 and 16 are formed to extend are also gradually changed with respect to the axis L1. More specifically, as shown in FIG. 2, each air inlet hole 14 located in the most upstream side of the mixing chamber wall 5 has a relatively large angle $\alpha 1$ (e.g., such an angle as causing a plane including the axis L2 of the air inlet hole 14 to intersect the axis L1 substantially at a right angle) between its axis L2 and the inner circumferential surface of the mixing chamber wall 5, i.e., the mixing-chamber inner wall surface 5*a*. The air inlet holes 15, 16 located in the intermediate and downstream sides of the mixing chamber wall 5 have a relatively small angle α2 (e.g., about 90°) between their axes L3, L4 and the inner circumferential surface of the mixing chamber wall 5, i.e., the mixing-chamber inner wall surface 5*a*. As a result, in combination with the above-described effect resulting from setting X/D to have a smaller value, the air for combustion ejected from the air inlet hole 14 flows into the mixing chamber 4 substantially at a right angle relative to the axis L1 (i.e., to the liquid fuel ejected from the first fuel nozzle 13).

Since the air inlet holes 15, 16 have relatively large X/D values as described above, the holes are opened to orient more closely to the circumferential direction, and the air inlet holes 15, 16 have larger-size outlet openings (in the side facing the mixing chamber 4). Therefore, if the air inlet holes 15, 16 are formed to have the same angle α1 relative to the mixing-chamber inner wall surface 5*a* as that of the air inlet hole 14, outlet openings of adjacent holes interfere with each other. This means that the number of the bored air inlet holes 15, 16 in the circumferential direction has to be reduced. According to this embodiment, however, since the angle between the axis L3, L4 of the air inlet hole 15, 16 and the mixing-chamber inner wall surface 5*a* is set to α2, i.e., a substantially right angle. Therefore, the size of each outlet opening of the air inlet hole 15, 16 can be reduced so as to ensure the necessary number of the bored air inlet holes 15, 16 in the circumferential direction. With that structure, the mixing chamber 4 and the mixing chamber wall 5 can be made more compact.

Figure 5:
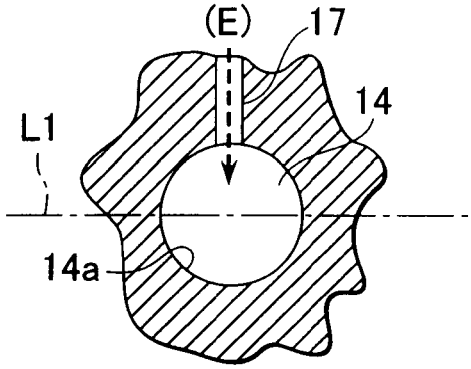
FIG. 5 is a sectional view (taken along the line V-V in FIG. 2) of a fuel supply portion, showing the air inlet holes serving as the channels in the first embodiment of the present invention.

FIG. 5 is a sectional view (taken along the line V-V in FIG. 2) of the mixing chamber wall 5 in a portion including the fuel hole 17 bored to be communicated with the air inlet hole 14. The fuel hole 17 is bored in one-to-one relation to the air inlet hole 14 at a right angle relative to the axis L1 so that the gaseous fuel is supplied toward the center of the air inlet hole 14, as indicated by an arrow (E) in FIG. 5.

The operating effects obtained with the gas turbine combustor and the combustion method for supply of fuel to the combustor according to the first embodiment of the present invention will be described below one by one.

(1) Effect of Preventing Backfire. When the gaseous fuel is supplied through the fuel holes 17, 18 and 19 in this embodiment, the gaseous fuel is ejected from the fuel holes 17, 18 and 19 into the air inlet holes 14, 15 and 16, respectively. Then, the gaseous fuel and the air for combustion introduced from the compressor 1 are introduced to the mixing chamber 4 through the air inlet holes 14, 15 and 16. The gaseous fuel ejected from the gaseous fuel holes 17, 18 and 19 and the air for combustion are sufficiently mixed in the mixing chamber 4 to produce a premixed gas mixture that is burnt in the combustion chamber 6 downstream of the mixing chamber 4. Resulting combustion gases are supplied to the gas turbine 3.

Here, if the air inlet holes 14, 15 and 16 are each of a structure having a length enough to premix the gaseous fuel introduced through the gaseous fuel holes 17, 18 and 19 and the air for combustion with each other and are narrowed in diameter in the downstream side or have bent portions, there is a risk of causing spontaneous ignition of the gas mixture in the air inlet holes 14, 15 and 16 or backfire, i.e., backward run of flames, into the air inlet holes 14, 15 and 16 from the combustion chamber 6 through the mixing chamber 4, and then holding the flames by vortexes generated in low flow-rate regions upstream of the narrowed portions or in the bent portions. Further, since the air for combustion introduced to the combustor 2 is compressed and produced by the compressor 1, dust or the like is often mixed into the air for combustion while the air for combustion flows through the channels. This also leads to a risk that, if burnable dust or the like is mixed into the air for combustion introduced through the air inlet holes 14, 15 and 16, it serves as a seed to make fire and flames are held by the vortexes generated in the low flow-rate regions upstream of the narrowed portions or in the bent portions of the air inlet holes 14, 15 and 16.

Even in the case of the air inlet holes including no mechanisms to generate vortexes possibly holding flames, if a structural component such as a fuel supply member is present on an outer surface of a swirler as in the related art (JP,A 2004-507701), the structural component disturbs the airflow around the swirler, and small but relatively strong vortexes are generated downstream of the structural component, thus causing flames to be held in the air inlet holes 14, 15 and 16 by the generated vortexes. Particularly, if the structural component such as the fuel supply member is present near an air inlet of the swirler as in the related art, the vortexes generated by the structural component directly flow into the swirler without decay, and a possibility of flames being held by the vortexes is increased. Also, if disturbances or vortexes are generated in the airflow at the air inlet of the swirler, the static pressure distribution at the air inlet of the swirler is changed, whereby the flow rate of air flowing into the swirler at an axial position of an air inlet of the combustor, which is opened to face in the axial direction, becomes different from a design value. This may lead to a possibility that the distribution of fuel concentration within the swirler is so disturbed as to generate combustion oscillations, and a flame is caused to run backward by the generated combustion oscillations.

In the event of those situations, the mixing chamber wall 5 may be susceptible to deformations or damages due to overheating, and therefore a failure of the overall gas turbine plant has to be taken into consideration.

In contrast, with this embodiment, the air inlet holes 14, 15 and 16 for introducing the air for combustion and the gaseous fuel ejected from the gaseous fuel holes 17, 18 and 19 to the mixing chamber 4 while mixing them are each of the structural component neither having shapes narrowed in diameter in the downstream side, nor including bent portions at which vortexes are possibly generated. Therefore, even if flames enter the air inlet holes 14, 15 and 16 due to spontaneous ignition, backward run of the flames, or mixing of the burnable dust or the like into the air for combustion, the flames are avoided from residing in the air inlet holes 14, 15 and 16, and are immediately expelled out into the mixing chamber 4. As a result, the trouble of flames running backward and being held in the air inlet holes 14, 15 and 16 can be prevented.

Further, with this embodiment, since the fuel holes 17, 18 and 19 are bored to be opened at the respective inner wall surfaces of the air inlet holes 14, 15 and 16, there are no structural components around the air inlet holes 14, 15 and 16, which may disturb the airflow or generate vortexes. Therefore, the airflow entering the mixing chamber is less susceptible to combustion oscillations, etc. and a flame can be avoided from running backward. As a result, this embodiment is able to suppress the occurrence of backfire.

(2) Effect of Reducing Amount of NOx Generated. In this embodiment, as shown in FIG. 5, the fuel holes 17, 18 and 19 are formed so as to eject the gaseous fuel through the inner wall surfaces of the air inlet holes 14, 15 and 16 in a direction substantially perpendicular to the airflow. The gaseous fuel ejected from the fuel hole 17 strikes against a wall surface 14*a* of the air inlet hole 14 and is diffused, which is positioned opposite to the fuel hole 17. Therefore, a contact area of the ejected fuel with the airflow passing through the air inlet hole 14 is increased and mixing of the gaseous fuel with the airflow is promoted correspondingly.

Also, as the fuel flow rate increases, the fuel ejection speed is increased and more efficient diffusion is realized when the ejected fuel strikes against the wall surface 14*a*, thus resulting in further promotion of the mixing of the gaseous fuel with the airflow.

In addition, since this embodiment has the structure capable of ejecting the gaseous fuel from the fuel hole 17 (18 or 19) in a direction substantially perpendicular to the airflow in the air inlet hole 14 (15 or 16) and setting the diameter of the air inlet hole 14 (15 or 16) to a relatively small value in comparison with penetration power (distance) of the gaseous fuel, the speed of the ejected fuel at the time of striking against the wall surface 14*a* is less attenuated and the gaseous fuel is more efficiently diffused to further promote the mixing of the gaseous fuel with the airflow.

As a result, the air for combustion and the gaseous fuel both introduced to the air inlet holes 14, 15 and 16 are sufficiently mixed with each other in the air inlet holes 14, 15 and 16 (a mixture of the air for combustion and the gaseous fuel in this state is referred to as a "primary gas mixture" hereinafter). Then, the primary gas mixture is ejected into the mixing chamber 4 from the air inlet holes 14, 15 and 16, and the mixing of the air for combustion and the gaseous fuel is promoted by eddy flows generated upon the ejection of the primary gas mixture (a mixture of the air for combustion and the gaseous fuel in this state is referred to as a "secondary gas mixture" hereinafter). Those eddy flows are ones usually generated when a channel size is increased in a stepwise manner.

In this embodiment, as described above, the angles of the air inlet holes 14, 15 and 16 relative to the circumferential direction are changed such that X/D increases as a position approaches the downstream side in the axial direction of the mixing chamber wall 5. With such an arrangement, at the upstream position in the mixing chamber 4, the secondary gas mixture ejected from each air inlet hole 14 flows in toward the vicinity of the position where the liquid fuel is ejected from the first fuel nozzle 13. Accordingly, the secondary gas mixtures ejected from the plurality of air inlet holes 14 collide with one another at high speeds, whereby the mixing is further promoted. On the other hand, at the intermediate and downstream positions in the mixing chamber 4, the secondary gas mixtures ejected from the air inlet holes 15, 16 flow in more closely to the inner circumferential surface of the mixing chamber wall 5, i.e., the mixing-chamber inner wall surface 5*a*. Accordingly, strong swirl flows are generated in the mixing chamber 4, causing the secondary gas mixtures ejected from the plurality of air inlet holes 15 and the plurality of air inlet holes 16 to collide with one another, whereby the mixing is further greatly promoted. In such a way, the secondary gas mixtures ejected from the air inlet holes 14, 15 and 16 are sufficiently mixed in the mixing chamber 4.

Also, with this embodiment, since the air inlet hole located in the more upstream side is formed to have a larger length, primary mixing of the gaseous fuel and the air for combustion is further promoted in the air inlet hole located in the more upstream side.

Meanwhile, the liquid fuel ejected from the first fuel nozzle 13 for the liquid fuel is atomized with shearing forces given by the air for combustion that is ejected from the air inlet holes 14 and collides with the flow of the liquid fuel substantially at a right angle. Further, a part of the ejected liquid fuel is evaporated into gases. Accordingly, mixing of the ejected liquid fuel with the air for combustion ejected from the air inlet holes 15, 16 is promoted while the liquid fuel is forced to flow toward the downstream side of the mixing chamber 4 (a mixture of the liquid fuel, the gaseous fuel and the air for combustion in such a state is referred to as a "premixed gas mixture" hereinafter).

Thus, in the mixing chamber 4 being of the single structure, sufficient mixing can be achieved between the gaseous fuel and the air for combustion and between the liquid fuel and the air for combustion so as to produce a homogeneous premixed gas mixture. Consequently, it is possible to reduce the amount of generated NOx regardless of which kind of fuel is used.

(3) Effect of Preventing Coking. With this embodiment, since X/D takes a smaller value at the upstream position in the mixing chamber 4, the air for combustion ejected from each air inlet hole 14 flows in toward the vicinity of the axis L1 of the mixing chamber wall 5, whereby strong swirl forces act only in a central region while the swirl flows are attenuated and the swirl forces become relatively small in a region near the inner circumferential surface of the mixing chamber wall 5, i.e., the mixing-chamber inner wall surface 5*a*. As a result, droplets of the liquid fuel ejected from the first fuel nozzle 13 for the liquid fuel are avoided from colliding with the inner circumferential surface of the mixing chamber wall 5, i.e., the mixing-chamber inner wall surface 5*a*, under the swirl action of the swirl flows. In other words, the occurrence of coking can be prevented.

Also, in the vicinity of the position where the liquid fuel is ejected from the first fuel nozzle 13, there may generate a stagnation region where ejected small liquid droplets stagnate. If such a stagnation region generates, a possibility of the liquid droplets adhering to the inner circumferential surface of the mixing chamber wall 5, i.e., the mixing-chamber inner wall surface 5*a*, is increased, which leads to the occurrence of coking. With this embodiment, since the air for combustion flows in from an entire region in the circumferential direction, as described above, toward the vicinity of the position where the liquid fuel is ejected from the first fuel nozzle 13, it is possible to suppress the generation of the stagnation region where the droplets of the liquid fuel are apt to adhere to the mixing-chamber inner wall surface 5*a*. As a result, the occurrence of coking can be prevented with reliability.

Further, liquid droplets having relatively large sizes may strike against the mixing-chamber inner wall surface 5*a* while overcoming the swirl forces of the swirl flows due to their own inertial forces. In spite of such a situation, with this embodiment, since the air inlet holes 14, 15 and 16 are formed over the entire region along the mixing-chamber inner wall surface 5*a* in the circumferential direction thereof, the air for combustion ejected from the air inlet holes 14, 15 and 16 acts to blow off the liquid droplets that are going to strike against the mixing-chamber inner wall surface 5*a*. As a result, the occurrence of coking can be prevented with higher reliability.

When a swirl type liquid fuel atomizer of pressure spray type, for example, is used as the first fuel nozzle 13 for the liquid fuel, the droplets of the liquid fuel ejected from the first fuel nozzle 13 are forced to flow outward of the axis L1 by centrifugal forces. Even in such a case, with this embodiment, since the air for combustion flows in from the entire region in the circumferential direction, as described above, toward the vicinity of the position where the liquid fuel is ejected from the first fuel nozzle 13 for supplying the liquid fuel, the ejected liquid droplets can be suppressed from spreading outward and can be prevented from striking against the mixing-chamber inner wall surface 5*a*. Further, in that case, since the action of shearing forces of the air for combustion upon the liquid fuel is maximized, it is possible to more efficiently atomize the liquid droplets and to greatly promote the mixing of the air for combustion and the liquid fuel.

(4) Effect of Improving Combustion Stability. With this embodiment, since any structural component disturbing the airflow or generating vortexes is not present on the mixing-chamber outer wall surface 5*b* that provides an inlet area for the air inlet holes, the air for combustion can be supplied to the mixing chamber at a stable flow rate and combustion stability can be improved.

Further, with this embodiment, the angles of the air inlet holes 14, 15 and 16 relative to the circumferential direction are changed such that X/D increases as a position approaches the downstream side in the axial direction of the mixing chamber wall 5. With such an arrangement, X/D takes a larger value at a position closer to the downstream side in the axial direction of the mixing chamber wall 5, and the premixed gas mixture flows into a combustion region while generating strong swirl flows in an outlet area of the mixing chamber 4. In the outlet area of the mixing chamber 4, therefore, a recirculation region is formed near the axis of the mixing chamber 4, and combustion stability can be further improved.

(5) Another Effect. With this embodiment, since the fuel holes 17, 18 and 19 are formed to be directly opened to the respective wall surfaces of the air inlet holes 14, 15 and 16 in the burner 11, the burner 11 has a compact outer cylindrical shape that is effective in reducing a probability of generation of separation vortexes, etc. which may possibly induce back-fire.

(6) Increase of Efficiency. With this embodiment, since the air for combustion flows smoothly, a pressure loss in the burner 11 can be reduced. As a result, overall efficiency of the gas turbine can be increased.

(Second Embodiment)

Figure 6:
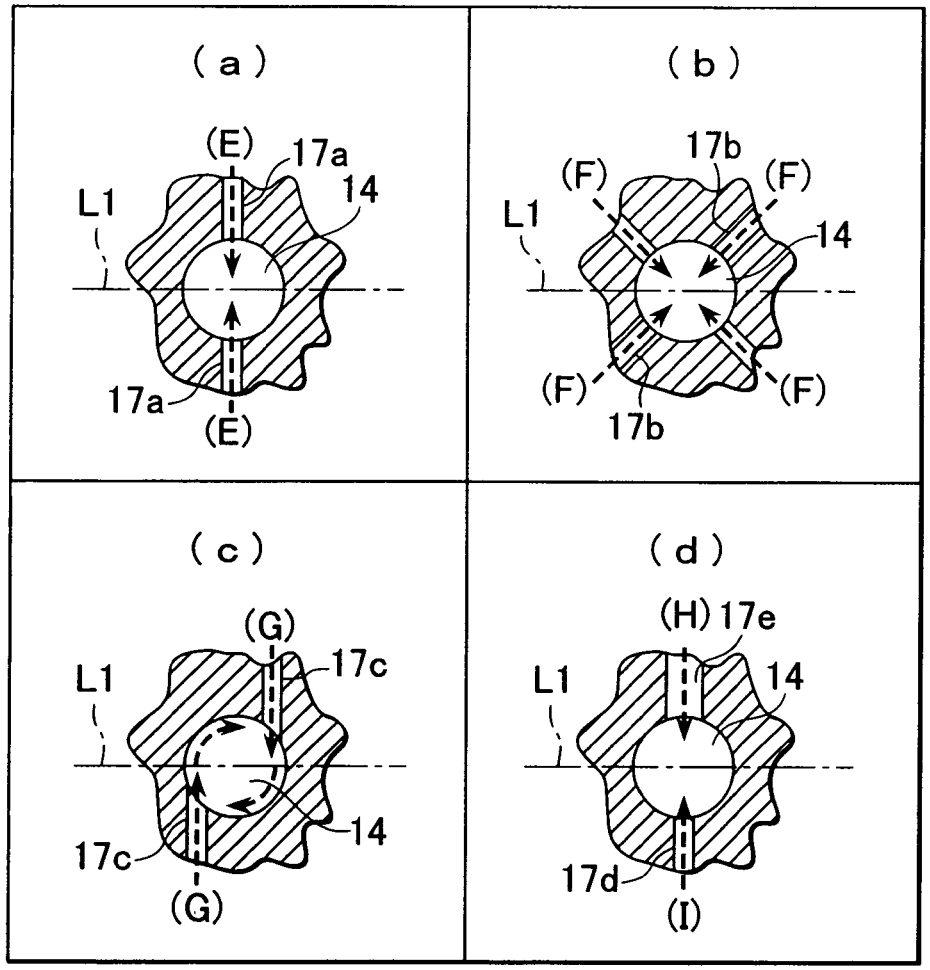
FIG. 6 is a sectional view of the fuel supply portion, showing air inlet holes serving as channels in a second embodiment of the present invention.

A gas turbine combustor according to a second embodiment of the present invention will be described below with reference to FIG. 6. FIG. 6 is a side sectional view showing the air inlet hole 14 and a part of the fuel hole 17 in the second embodiment.

In the first embodiment, as described above, since the fuel holes 17, 18 and 19 are formed so as to eject the gaseous fuel into the interiors of the corresponding air inlet holes in a direction substantially perpendicular to the airflow, the gaseous fuel ejected from each fuel hole strikes against the wall surface of the air inlet hole 14 and is diffused, which is positioned opposite to the fuel hole. Accordingly, the primary mixing of the gaseous fuel with the airflow in the air inlet hole is greatly promoted.

In the second embodiment shown at (a) through (d) in FIG. 6, each fuel hole is formed, as in the first embodiment, such that the gaseous fuel is ejected in a direction substantially perpendicular to the airflow.

FIG. 6(*a*) shows one example in which two fuel holes 17*a* are formed to be opened to one air inlet hole 14. The fuel holes 17*a* are disposed in positions opposite to each other. Therefore, the gaseous fuel is ejected toward the center of the air inlet hole 14 from two opposite directions, as indicated by arrows (E) in the drawing.

FIG. 6(*b*) shows another example in which four fuel holes 17*b* are formed to be opened to one air inlet hole 14. The fuel holes 17*b* are disposed in positions opposite to each other in pairs as in the structure of FIG. 6(*a*). Therefore, the gaseous fuel is ejected toward the center of the air inlet hole 14 from four directions, as indicated by arrows (F) in the drawing.

In each of FIGS. 6(*a*) and 6(*b*), since the number of fuel holes is increased in comparison with the first embodiment, a contact area of the gaseous fuel with the air is increased and mixing of them is promoted correspondingly. Also, in each of FIGS. 6(*a*) and 6(*b*), since one or two pairs of the fuel holes are formed in opposite positions and flows of the gaseous fuel ejected from the fuel holes collide with each other at the center of the air inlet hole and are diffused, the mixing of the gaseous fuel and the air is further promoted with an increase of the contact area between them. Additionally, in this embodiment, as the flow rate of the supplied fuel increases, the fuel ejection speeds from the fuel holes 17*a*, 17*b* are increased and more efficient diffusion is realized when the flows of the ejected fuel collide with each other, thus resulting in further promotion of the mixing.

FIG. 6(*c*) shows still another example in which two fuel holes 17*c* are formed to be opened to one air inlet hole 14. The fuel holes 17*c* are disposed nearly tangential to the inner wall surface of the air inlet hole such that flows of the gaseous fuel are ejected to advance along the inner wall surface of the air inlet hole and to swirl in the air inlet hole 14, as indicated by arrows (G) in the drawing. Since the gaseous fuel ejected from the fuel holes 17*c* flows downward while swirling in the air inlet hole 14 as indicated by the arrows (G), a contact time of the gaseous fuel with the air for combustion is prolonged and the mixing of the gaseous fuel with the air is greatly promoted. Although this example shows the case forming two fuel holes for one air inlet hole, the effect of promoting the mixing is also expected when only one fuel hole 17*c* is formed.

In any of FIGS. 6(*a*), 6(*b*) and 6(*c*), the primary mixing is promoted with the effect of increasing the contact area or the contact time of the gaseous fuel with the airflow. As a result, the secondary mixing in the mixing chamber 4 is also promoted, whereby the amount of NOx generated can be further reduced.

FIG. 6(*d*) shows an example in which two fuel holes 17*d*, 17*e* having cross-sectional areas different from each other are formed to be opened to one air inlet hole 14. The fuel hole 17*d* ejects main gaseous fuel, and the fuel hole 17*e* ejects sub-gaseous fuel differing in heating value from the main gaseous fuel.

In petrochemical plants or the likes, during the process of producing main fuel, various kinds of byproduct fuel are also produced in some cases. In gas turbine power-generation equipment installed in such a plant, there is an increasing demand for using the byproduct fuel as fuel for a gas turbine combustor. To meet that demand, in this example, the main gaseous fuel is ejected from the fuel hole 17*d* as indicated by an arrow (I) in the drawing, and the byproduct fuel is ejected from the fuel hole 17*e* as indicated by an arrow (H). Accordingly, the air, the main fuel, and the byproduct fuel are mixed with one another in the air inlet hole, whereby mixing of them is promoted. The cross-sectional area of the fuel hole 17*e* is adjusted depending on the flow rate of the byproduct fuel. The gaseous fuel supplied to the fuel hole 17*e* is not limited to combustible gaseous fuel, and it may be nitrogen, steam or the like.

(Third Embodiment)

A gas turbine combustor according to a third embodiment of the present invention will be described below with reference to FIG. 7. In this third embodiment, the axial length of the mixing chamber wall is extended and the air inlet holes are arranged to be concentrated in the upstream side of the mixing chamber wall.

Figure 7:
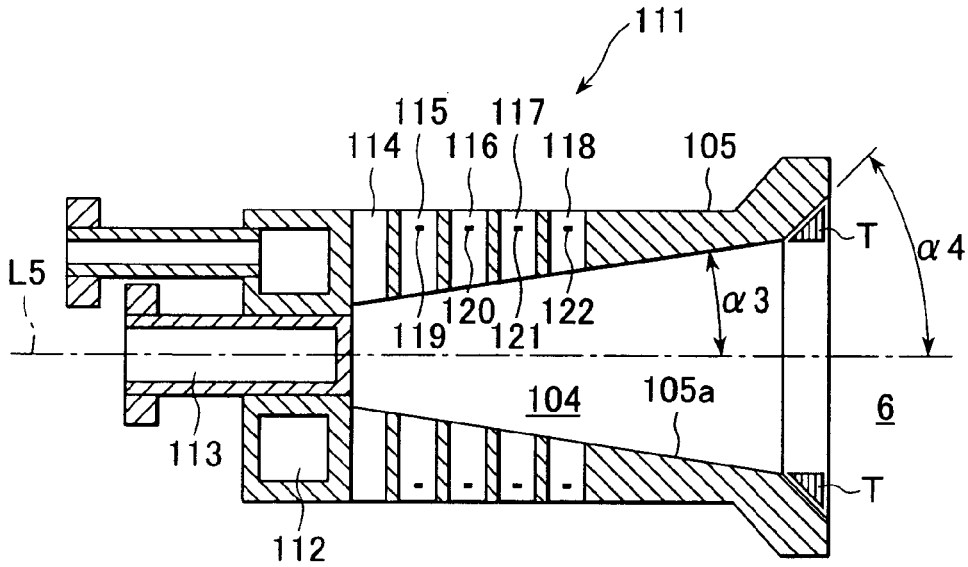
FIG. 7 is a sectional view showing a burner structure in a combustor according to a third embodiment of the present invention.

In a burner 111 of this embodiment, as shown in FIG. 7, a mixing chamber wall 105 is formed to have a spreading angle smaller than and an axial length larger than those of the mixing chamber wall 5 in the first embodiment. Then, air inlet holes 114, 115, 116, 117 and 118 are bored in layout concentrated in the upstream side of the mixing chamber wall 105. As in the first embodiment, the air inlet holes 114, 115, 116, 117 and 118 are formed at angles gradually changed relative to the circumferential direction such that X/D increases as a position approaches the downstream side of the mixing chamber wall 105 in the axial direction thereof, i.e., such that the air inlet hole 114 has a smaller X/D value and the air inlet hole 118 has a larger X/D value. In this embodiment, however, angles at which the air inlet holes 114, 115, 116, 117 and 118 are formed relative to an axis L5 of the mixing chamber wall 105 are not changed depending on the hole positions along the axis L5. Namely, all planes including respective axes (not shown) of the air inlet holes 114, 115, 116, 117 and 118 intersect the axis L5 substantially at a right angle.

Gaseous fuel holes 119, 120, 121 and 122 for ejecting gaseous fuel are formed to be opened in plural-to-one relation to the air inlet holes 115, 116, 117 and 118, respectively, such that one or more pairs of the gaseous fuel holes are positioned opposite to each other with corresponding one of the air inlet holes 114, 115, 116, 117 and 118 interposed therebetween, as shown in FIG. 6(*a*). With that arrangement, as in the second embodiment, the gaseous fuel can be ejected from the gaseous fuel holes 119, 120, 121 and 122 in a direction substantially perpendicular to respective axes (not shown) of the air inlet holes 115, 116, 117 and 118.

Also, the spreading angle of an inner circumferential surface (chamber inner wall surface) 105*a* of the mixing chamber wall 105 relative to the axis L5 is set to a relatively small angle α3 in the upstream and intermediate sides of a mixing chamber 104 and to a relatively large angle α4 in the downstream side thereof. Thus, the spreading angle is increased in an outlet region of the mixing chamber 104.

The third embodiment thus constituted can provide not only the above-described effects of preventing backfire, reducing the amount of NOx generated, preventing coking, and improving combustion stability which are obtained with the first and second embodiments, but also the following effects.

(7) Effect of Further Improving Combustion Stability. With this third embodiment, since the inner circumferential surface 105*a* of the mixing chamber wall 105 is formed to have a larger spreading angle relative to the axis L5 in the outlet region of the mixing chamber 104, the axial speed of the premixed gas mixture is decelerated in the outlet region and a recirculation flow region (indicated by T in FIG. 7) is formed around a flame. As a result, flame holding power can be so increased as to prevent, for example, unstable flame oscillations in the axial direction. It is hence possible to further improve combustion stability.

(8) Effect of More Reliably Preventing Backfire. With this embodiment, when the gaseous fuel is ejected from the gaseous fuel holes 119, 120, 121 and 122, flames can be prevented from being held in the air inlet holes 115, 116, 117 and 118, as with the first embodiment, because any structural component disturbing the airflow or generating vortexes is not present near the upstream side of the air inlet holes 115, 116, 117 and 118. On the other hand, when swirl flows are formed in the mixing chamber 4, 104 as in the first embodiment and the third embodiment, a recirculation region is generated at the center (area around the axis L1, L5) of the swirl flows in the outlet region of the mixing chamber, whereby combustion stability can be improved. In some cases, however, there is a possibility that a flame runs backward into the mixing chamber 4, 104 from a combustion region.

In this respect, since combustion stability can be further improved with the third embodiment as described in above (7), the combustion stability can be maintained at a level comparable to that in the first embodiment even when the swirl forces of the premixed gas mixture in the outlet region of the mixing chamber are weakened. Stated another way, combustion stability can be maintained by setting X/D of the air inlet holes 114, 115, 116, 117 and 118 to small values so that the swirl flows in the outlet region of the mixing chamber are weakened and the formation of the recirculation region is lessened to suppress backward run of flames. Thus, by adjusting X/D and an outlet-region spreading angle α4 to adjust balance between the swirl forces and the axial speed of the premixed gas mixture, the flame can be suppressed from running backward to the interior of the mixing chamber 104 from the combustion region while maintaining the combustion stability. It is hence possible to more reliably prevent backfire.

(9) Effect of Further Reducing Amount of NOx Generated. With this embodiment, since the mixing chamber wall 105 is formed to have a relatively large axial length and the air inlet holes 114, 115, 116, 117 and 118 are bored in layout concentrated in the upstream side of the mixing chamber wall 105, a mixing distance in the mixing chamber 104 can be increased. This arrangement is able to further promote the mixing of flows of the secondary gas mixtures (i.e., the gaseous fuel and the air for combustion) ejected from the air inlet holes 115, 116, 117 and 118.

Also, when the liquid fuel is ejected from a liquid fuel nozzle 113, the liquid fuel ejected from the liquid fuel nozzle 113 evaporates in a larger rate corresponding to an increase of the mixing distance. Simultaneously, the mixing of the liquid fuel and the air for combustion can also be further promoted and a more homogeneous premixed gas mixture can be produced. It is hence possible to further reduce the amount of NOx generated.

(10) Effect of Suppressing Overheating of Liquid Fuel Nozzle. In this embodiment, the gaseous fuel hole is not formed in the air inlet hole 114 in the uppermost side of the mixing chamber 104, and only the air for combustion is ejected from the air inlet hole 114.

When the gaseous fuel is ejected from the gaseous fuel hole and burnt, the so-called flicker, i.e., a phenomenon that a fire is turned on and off, may occur if a fuel concentration is reduced at the start of fuel supply or due to a failure of a fuel supply line. The occurrence of the flicker fluctuates pressure within the combustor, and the pressure fluctuations cause the flame to run backward into the mixing chamber 104, whereby the interior of the mixing chamber 104 and the liquid fuel nozzle 113 are overheated in some cases. With this embodiment, since only the air for combustion is ejected from the air inlet hole 114 closest to the liquid fuel nozzle 113, the liquid fuel nozzle 113 is cooled by the air for combustion ejected from the air inlet hole 114. As a result, in spite of the occurrence of the flicker, the liquid fuel nozzle 113 can be prevented from being overheated.

(11) Effect of Suppressing Generation of Combustion Oscillations. Since the mixing distance during which the premixed gas mixture is produced is increased, this third embodiment can realize combustion characteristics closer to premixed combustion than those obtained with the first embodiment. When the premixed combustion is performed, combustion oscillations may often generate which means a phenomenon that the pressure in the combustor 2 (i.e., the pressures in the mixing chamber 104 and the combustion chamber 6) changes cyclically. The combustion oscillations are generated in several oscillation modes. If a particular oscillation mode is excited depending on the combustion state, a pressure amplitude is increased with the combustion oscillations. The pressure amplitude increased with the combustion oscillations accelerates wear of sliding surfaces of parts constituting the combustor 2. For that reason, it is important to prevent the generation of the combustion oscillations.

Usually, in the gas turbine plant to which this embodiment is applied, when the pressure in the combustor 2 and the pressure in the gas turbine 3 take a certain pressure ratio, a flow speed of the combustion gases reach the speed of sound in a first-stage nozzle throat 30 (see FIG. 1). If a fluid flow speed reaches the speed of sound, component members are regarded, from the viewpoint of acoustics, as solid walls through which sound waves cannot propagate. Accordingly, in this embodiment, there arises a possibility of causing an oscillation mode with boundary conditions given by opposite ends of the combustor 2 (i.e., the first-stage nozzle throat 30 and an inlet portion of the combustor 2). This may lead to a risk that a pressure wave is repeatedly reflected between the first-stage nozzle throat 30, i.e., one reflecting end, and the inlet portion of the combustor 2, i.e., the other reflecting end, and that the pressure amplitude is increased with the formation of a standing wave.

With this embodiment, since the mixing chamber wall 105 having a hollow conical shape and a small reflectance is disposed in the inlet portion of the combustor 2 serving as the other reflecting end, the pressure wave is damped by the mixing chamber wall 105 when it impinges upon the mixing chamber wall 105, whereby the generation of the combustion oscillations can be suppressed. Note that this effect of suppressing the generation of the combustion oscillations can also be obtained in the first and second embodiments as well.

(Fourth Embodiment)

A gas turbine combustor and a combustion method for supplying fuel to the combustor according to a fourth embodiment of the present invention will be described below with reference to FIG. 8. In this fourth embodiment, the spreading angle of in the outlet region of the mixing chamber is set to a smaller value than that in the third embodiment.

Figure 8:
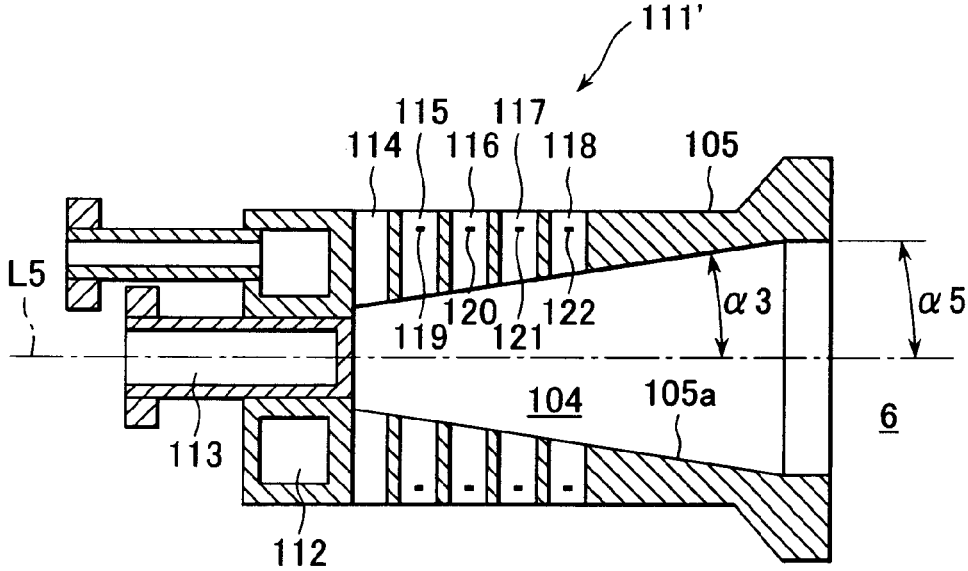
FIG. 8 is a sectional view showing a burner structure in a combustor according to a fourth embodiment of the present invention.

FIG. 8 is a side sectional view showing a detailed burner structure in the fourth embodiment. Similar parts in FIG. 8 to those in FIG. 7 showing the third embodiment are denoted by the same symbols and a description of such parts is omitted here.

As shown in FIG. 8, a burner 111' in this fourth embodiment is formed such that the outlet region of the mixing chamber 104 has a spreading angle $\alpha$5 smaller than $\alpha$3 of the mixing chamber 104. In other words, the cross-sectional area of the mixing chamber 104 in the outlet region thereof is reduced to increase the outlet speed of the premixed gas mixture as compared with the third embodiment.

The fourth embodiment thus constituted can provide not only the above-described effects of preventing backfire, reducing the amount of NOx generated, preventing coking, improving combustion stability, suppressing overheating of the liquid fuel nozzle, and suppressing generation of combustion oscillations which are obtained with the third embodiment, but also the following effects.

(12) Effect of Further Reducing Amount of NOx Generated. With this embodiment, since the inner circumferential surface 105*a* of the mixing chamber wall 105 is formed to have a smaller spreading angle relative to the axis L5 in the outlet region of the mixing chamber 104, the axial speed of the premixed gas mixture is accelerated in the outlet region, whereby the position of a premixed combustion flame held in the downstream side of the mixing chamber 104 can be shifted to a more downward position than that in the third embodiment. Thus, the premixing distance is increased corresponding to the flame being held at a more downward position. Consequently, it is possible to promote the mixing of the fuel and the air for combustion, and to reduce the amount of NOx generated.

(Fifth Embodiment)

Figure 10:
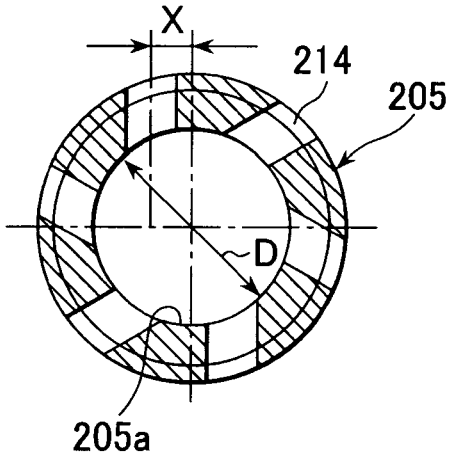
FIG. 10 is a sectional view showing air inlet holes (214) serving as channels in the fifth embodiment of the present invention.
Figure 11:
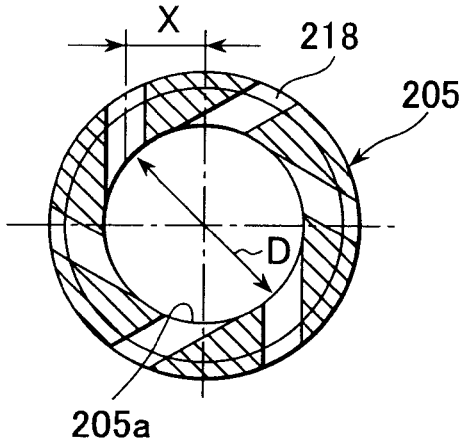
FIG. 11 is a sectional view showing air inlet holes (218) serving as channels in the fifth embodiment of the present invention.

A gas turbine combustor according to a fifth embodiment of the present invention will be described below with reference to FIGS. 9 through 11. In this fifth embodiment, the inner wall of the mixing chamber is formed in a hollow cylindrical shape, and the cross-sectional area of the air inlet hole in the upstream side in the axial direction is set to be larger than those of the air inlet holes in the downstream side.

Figure 9:
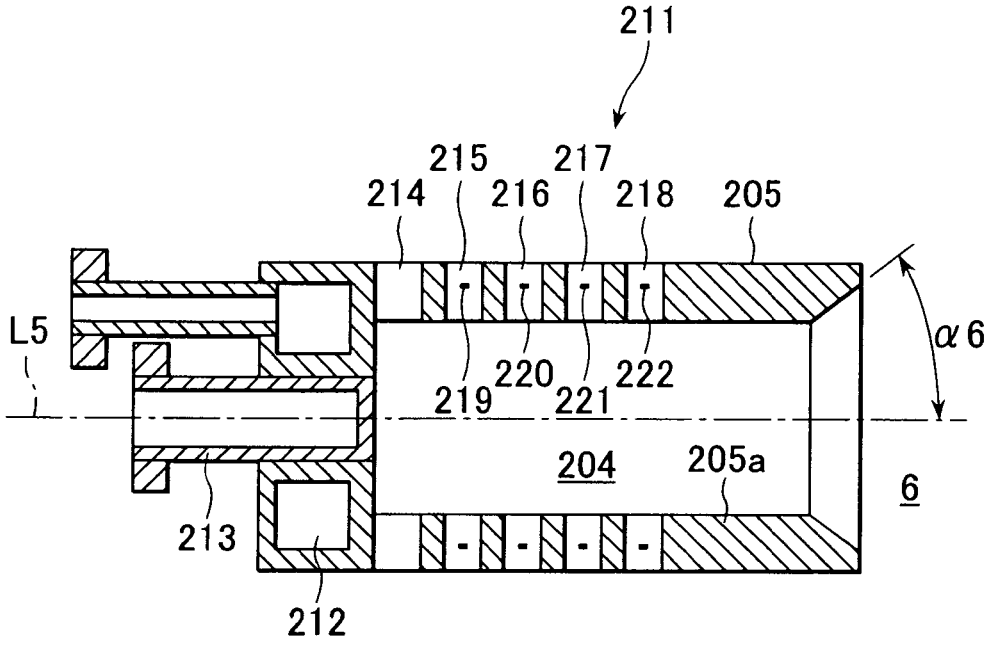
FIG. 9 is a sectional view showing a burner structure in a combustor according to a fifth embodiment of the present invention.

In a burner 211 of this embodiment, as shown in FIG. 9, a mixing chamber wall 205 is formed to have an inner circumferential surface (mixing-chamber inner wall surface) 205*a* in cylindrical shape of the same diameter in the axial direction. An air inlet hole 214 formed in the most upstream side of the mixing chamber wall 205 has an inner diameter larger than those of other air inlet holes 215, 216, 217 and 218. Further, like the third embodiment, the air inlet holes 214, 215, 216, 217 and 218 are formed at angles gradually changed relative to the circumferential direction, as shown in FIGS. 10 and 11, such that X/D increases as a position approaches the downstream side of the mixing chamber wall 205 in the axial direction thereof, i.e., such that the air inlet hole 214 has a smaller X/D value and the air inlet hole 218 has a larger X/D value.

Gas fuel holes 219, 220, 221 and 222 for ejecting gaseous fuel are formed to be opened in plural-to-one relation to the air inlet holes 215, 216, 217 and 218, respectively, such that one or more pairs of the gaseous fuel holes are positioned opposite to each other with corresponding one of the air inlet holes 215, 216, 217 and 218 interposed therebetween. With that arrangement, as in the third embodiment, the gaseous fuel can be ejected from the gaseous fuel holes 219, 220, 221 and 222 in a direction substantially perpendicular to respective axes (not shown) of the air inlet holes 215, 216, 217 and 218.

Also, the spreading angle of the inner circumferential surface 205*a* of the mixing chamber wall 205 relative to the axis L5 is set to a relatively large angle $\alpha$6 in the downstream side of the mixing chamber 204. In other words, the spreading angle is increased in an outlet region of the mixing chamber 204.

The fifth embodiment thus constituted can provide not only effects similar to the above-described ones which are obtained with the third embodiment, but also the following effects.

(13) Effect of Reducing Burner Manufacturing Cost. With this embodiment, since the inner circumferential surface 205*a* of the mixing chamber wall 205 has a hollow cylindrical shape, the effect of reducing the burner manufacturing cost as compared with the first through fourth embodiments can be expected. In the case of the mixing chamber wall 205 having a hollow cylindrical shape, there arises a risk unlike the first through fourth embodiments that the flow speed of the premixed gas mixture in the upstream side of the mixing chamber 204 is so decelerated as to induce backward run of a flame. In spite of such a risk, with this embodiment, since the air inlet hole 214 in the upstream side has a larger cross-sectional area, it is possible to suppress the flow speed of the premixed gas mixture from being decelerated in the upstream side of the mixing chamber 204, and to prevent the flame from running backward.

(Sixth Embodiment)

A gas turbine combustor according to a sixth embodiment of the present invention will be described below with reference to FIGS. 12 through 14. In this sixth embodiment, a small mixing chamber having a hollow conical shape is formed inside a large mixing chamber having a hollow cylindrical shape, and the air inlet holes are formed to introduce the air for combustion to both of the mixing chambers.

Figure 12:
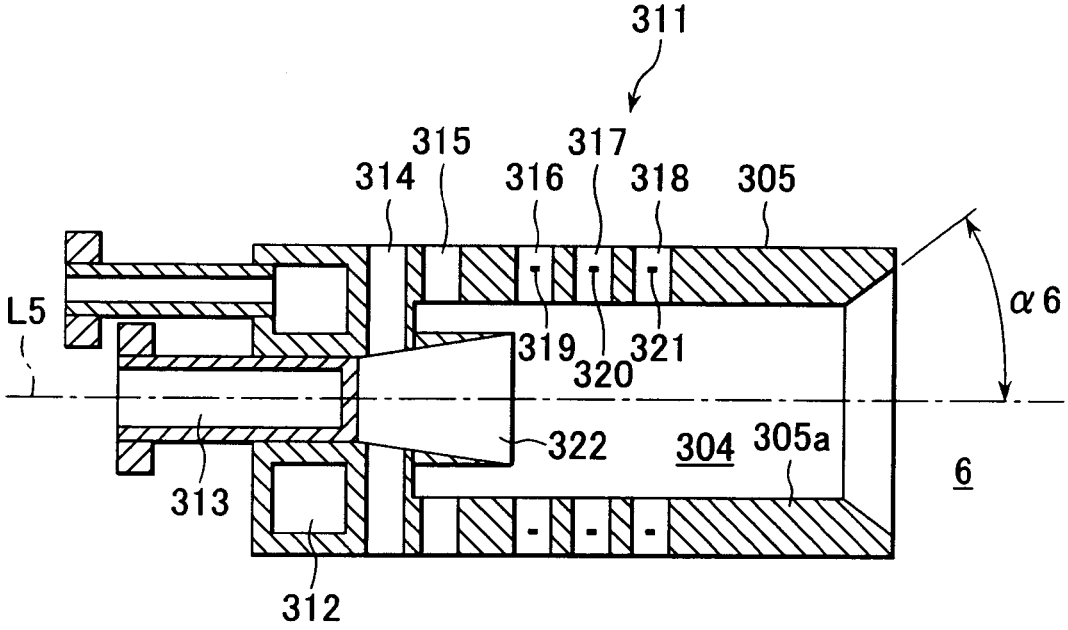
FIG. 12 is a sectional view showing a burner structure in a combustor according to a sixth embodiment of the present invention.

In a burner 311 of this embodiment, as shown in FIG. 12, a second mixing chamber wall 305 is formed to have an inner circumferential surface (mixing-chamber inner wall surface) 305*a* in cylindrical shape, and air inlet holes 315, 316, 317 and 318 for introducing the air for combustion to a second mixing chamber 304 are formed in the second mixing chamber wall 305. Also, a first mixing chamber 322 having a hollow conical shape and being smaller than the second mixing chamber 304 is formed at an upstream end of the second mixing chamber 304, and an air inlet hole 314 for introducing the air for combustion to a first mixing chamber 322 is formed in the second mixing chamber wall 305. Further, a liquid fuel nozzle 313 is disposed at an upstream end of the first mixing chamber 322.

Figure 13:
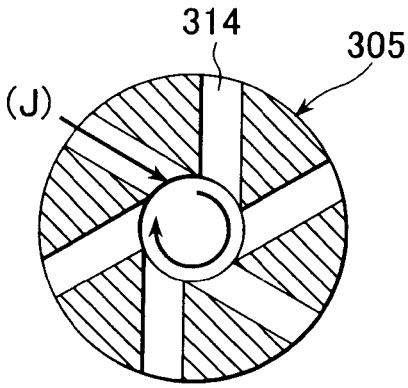
FIG. 13 is a sectional view showing air inlet holes (314) serving as channels in the sixth embodiment of the present invention.
Figure 14:
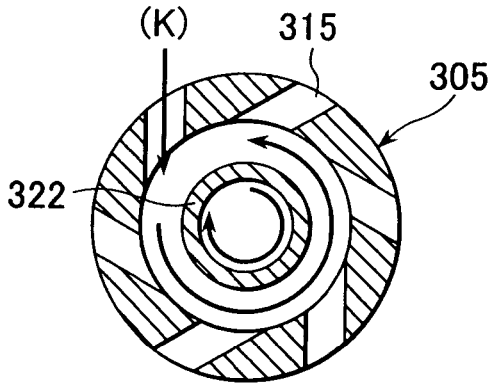
FIG. 14 is a sectional view showing air inlet holes (315) serving as channels in the sixth embodiment of the present invention.

As shown in FIG. 13, the air inlet hole 314 for introducing the air for combustion to the first mixing chamber 322 is formed in plural such that swirl flows are produced to act clockwise looking from the downstream side of the burner 311, as indicated by arrows (J) in the drawing. As shown in FIG. 14, the air inlet hole 315 (316, 317 or 318) communicating with the second mixing chamber 304 is formed in plural such that swirl flows are produced to act counterclockwise looking from the downstream side of the burner 311, as indicated by arrows (K) in the drawing. Further, as shown in FIG. 14, the air inlet holes 315 (316, 317 or 318) communicating with the second mixing chamber 304 are formed to cause stronger swirl actions.

Gas fuel holes 319, 320 and 321 for ejecting gaseous fuel are formed to be opened in plural-to-one relation to the air inlet holes 316, 317 and 318, respectively, such that one or more pairs of the gaseous fuel holes are positioned opposite to each other with corresponding one of the air inlet holes 316, 317 and 318 interposed therebetween. With that arrangement, as in the fifth embodiment, the gaseous fuel can be ejected from the gaseous fuel holes 319, 320 and 321 in a direction substantially perpendicular to respective axes (not shown) of the air inlet holes 316, 317 and 318.

Also, the spreading angle of the inner circumferential surface 305*a* of the mixing chamber wall 305 relative to the axis L5 is set to a relatively large angle $\alpha$6 in the downstream side of the mixing chamber 304. In other words, the spreading angle is increased in an outlet region of the mixing chamber 304.

The sixth embodiment thus constituted can provide not only effects similar to the above-described ones which are obtained with the fifth embodiment, but also the following effects.

In this sixth embodiment, when liquid fuel is ejected from the liquid fuel nozzle 313, the liquid fuel ejected from the liquid fuel nozzle 313 is atomized with shearing forces given by the airflows entering from the air inlet holes 314 as in the first through fifth embodiments. The atomized liquid droplets are carried with the airflows ejected from the air inlet holes 314 and flow downstream into the second mixing chamber 304 while swirling clockwise. Because the air inlet holes 315, 316, 317 and 318 communicating with the second mixing chamber 304 are all formed to cause the counterclockwise swirl actions as shown in FIG. 14, the airflows swirling in the opposed directions cross each other at an outlet of the first mixing chamber 322. Therefore, very strong shearing forces act at the boundary between the airflows crossing each other, and the liquid droplets passing through the outlet of the first mixing chamber 322 are further atomized. As a result, mixing of the liquid droplets with the airflows is promoted and the amount of NOx generated can be reduced.

When the liquid droplets sprayed from the liquid fuel nozzle 313 spread in a conical shape, there is a possibility that the liquid droplets adhere to an inner circumferential surface of the first mixing chamber 322. The liquid droplets adhering to the inner circumferential surface of the first mixing chamber 322 form a liquid film, which flows downstream into the second mixing chamber 304. However, since strong shearing forces of the swirling airflows act at the outlet of the first mixing chamber 322, the liquid film is torn off and atomized at the outlet of the first mixing chamber 322. As a result, mixing of the liquid fuel with the airflows is promoted and the amount of NOx generated can be reduced.

When such disturbances of the airflows are generated in the mixing chamber, there is a possibility that, if a flame runs backward during combustion of the gaseous fuel, the flame is held by the disturbances of the airflows and the burner 311 is burnt out. With this embodiment, however, since the fuel holes 319, 320 and 321 are formed only in the air inlet holes 316, 317 and 318 communicating with the first mixing chamber 322 in the downstream side thereof, the gaseous fuel is not supplied to the region where the disturbances of the airflows are generated, thus resulting a low possibility that the flame is held inside the second mixing chamber 304.

While, in the above description, the air inlet holes are formed to produce the air flows swirling in opposed directions in the first and second mixing chambers, similar effect to that described above can also be obtained even when the swirling directions of the air flows are the same in both the first and second mixing chambers.

While the first fuel nozzles 13, 113, 213 and 313 for the liquid fuel are not described in detail in the first through sixth embodiments of the present invention, those first fuel nozzles 13, 113, 213 and 313 may be each any spray type liquid fuel nozzle, such as a pressure-spray swirl type atomizer (with a single orifice or double orifices), a pressure-spray collision nozzle, or a spray air nozzle. Also, while any of the above-described embodiments has been described as having only one first fuel nozzle 13, 113, 213 or 313 for the liquid fuel, the present invention is not limited to such an arrangement and a plurality of liquid fuel nozzles may be disposed for one mixing chamber.

(Seventh Embodiment)

A gas turbine combustor according to a seventh embodiment of the present invention will be described below with reference to FIG. 15. In this seventh embodiment, the combustor is constituted in a combination of two types of burners by disposing the burner according to the first embodiment as a pilot burner at the center and the burner according to the third embodiment in plural as main burners around the pilot burner.

Figure 15:
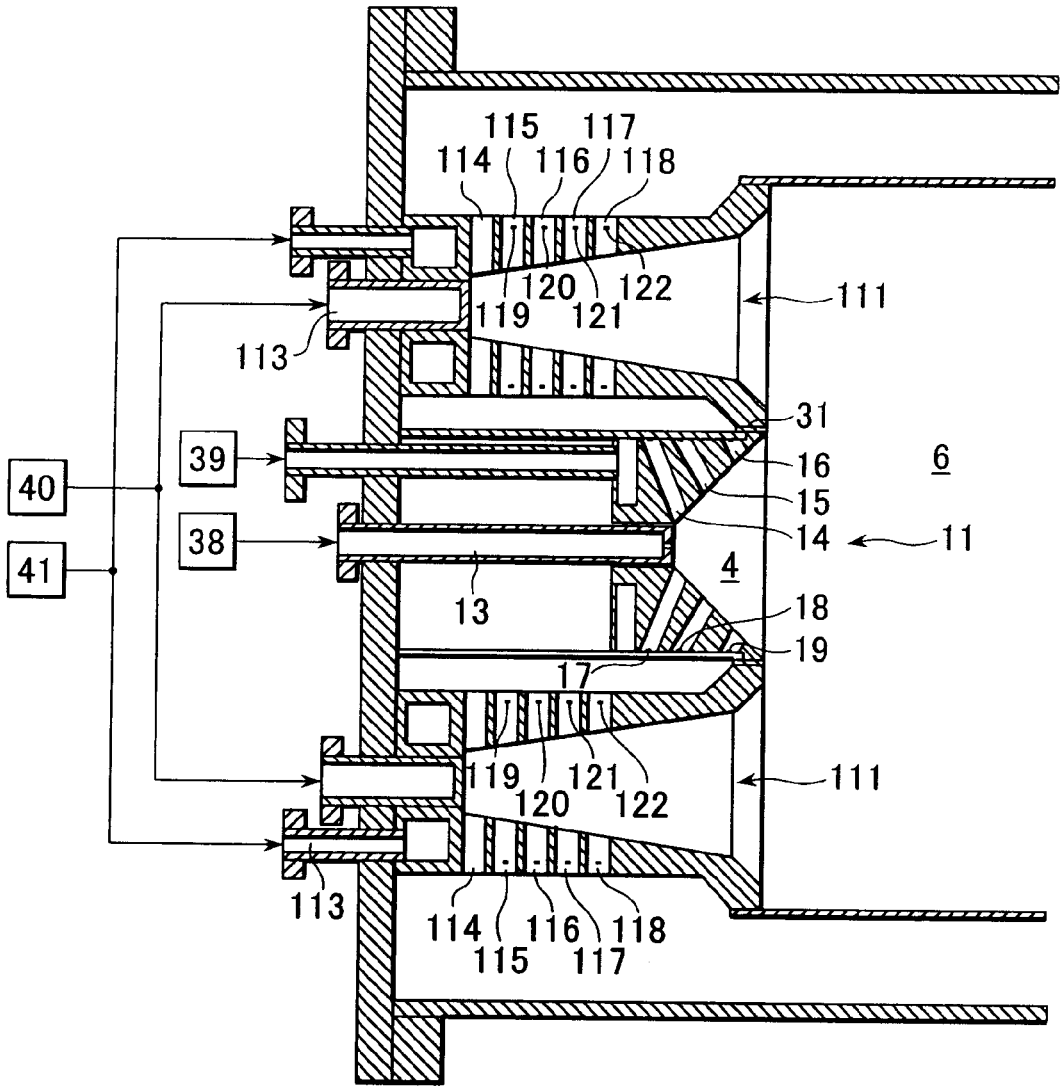
FIG. 15 is a sectional view showing a burner structure in a combustor according to a seventh embodiment of the present invention.

FIG. 15 is a side sectional view showing, in enlarged scale, an inlet portion of the combustor according to the seventh embodiment. Similar parts in FIG. 15 to those in FIGS. 2 and 7 showing respectively the first and third embodiments are denoted by the same symbols and a description of such parts is omitted here.

In this seventh embodiment, as shown in FIG. 15, the burner 11 according to the first embodiment is disposed as a pilot burner at the center of an inlet of the combustion chamber 6, and the burner 111 according to the third embodiment is disposed in plural as main burners around the pilot burner. Plates 31 are disposed between an outlet of the pilot burner 11 and outlets of the main burners 111 to assist holding of flames. In the pilot burner 11, a liquid fuel supply line 38 is connected to the first fuel nozzle 13 for liquid fuel and a gaseous fuel supply line 39 is connected to the gaseous fuel holes 17, 18 and 19. In each of the main burners 111, a liquid fuel supply line 40 is connected to the liquid fuel nozzle 113 and a gaseous fuel supply line 41 is connected to the gaseous fuel holes 119, 120, 121 and 122.

In the burner 11 according to the first embodiment, the mixing chamber wall 5 is formed to have a larger spreading angle and a shorter mixing distance in the axial direction than those in the burner 111 according to the third embodiment. Also, the air inlet holes 14, 15 and 16 are bored in the mixing chamber wall 5 all over the upstream, intermediate and downstream sides. Therefore, even if a flame comes close to the mixing chamber 4, a temperature rise of the mixing chamber wall 5 can be suppressed. This means that the ratio of a flow rate of fuel (liquid fuel, gaseous fuel, or a mixture of liquid and gaseous fuel) to a flow rate of the air for combustion can be set to a larger value, and the burner 11 can provide stable combustion in a combustion state closer to diffusive combustion than the burner 111. For that reason, in this embodiment, the burner 11 is employed as the pilot burner and is ignited in a startup and speedup stage of the gas turbine plant in which the fuel-air ratio and the flow rate of combustion gases are largely changed.

On the other hand, the burner 111 according to the third embodiment has a narrower combustion stable range because of having a longer mixing distance in the axial direction and provides combustion characteristics closer to premixed combustion than the burner 11 according to the first embodiment. For that reason, in this seventh embodiment, the burner 111 is employed as the main burner and is ignited in a low load stage (state after the startup and speedup stage) of the gas turbine plant in which change in the flow rate of the air for combustion is reduced. Then, a combustion rate of the burner 111 is increased after entering a constant load state. By operating the burners in such a manner, the amount of NOx generated can be reduced.

With this seventh embodiment thus constituted, since the two types of burners 11 and 111 having different combustion characteristics from each other are employed, stable combustion can be realized over a wide range of load fluctuations from the startup and speedup stage to the constant load stage of the gas turbine plant.

While the seventh embodiment of the present invention has been described as using two types of burners differing in structure, i.e., the pilot burner and the main burner, the present invention is not limited to that embodiment, and burners having the same structure may be used. For example, because the burner 11 according to the first embodiment can be operated in states changing from the diffusive combustion state to the premixed combustion state just by controlling the fuel flow rate, the burner 11 may be used as each of the pilot burner and the main burner. This modification can also provide similar effects to those obtained with the seventh embodiment.

Further, it is possible to provide similar effects to those obtained with the seventh embodiment by using, as the main burner, the combined structure of the third and fourth embodiments.

As described above in connection with the first embodiment, any structural component disturbing the airflow or generating vortexes is not present near the upstream side of the air inlet holes in the seventh embodiment as well.

If a structural component such as a fuel supply member is present on an outer surface of a swirler as in the related art (JP,A 2004-507701), the structural component disturbs the airflow around the swirler, and small but relatively strong vortexes are generated downstream of the structural component, thus causing flames to be held in the air inlet holes by the generated vortexes.

Particularly, in the case using a plurality of swirlers arranged in a multi-structure like the seventh embodiment, the vortexes generated by the fuel supply member for the adjacent swirler may flow into that swirler. Under influences of the generated vortexes, the static pressure distribution at an inlet of particular one of the plural swirlers is changed, whereby the flow rate of air flowing into that one swirler becomes different from a design value. This may lead to a possibility that the distributions of fuel concentration within the swirlers are so disturbed as to generate combustion oscillations, and a flame is caused to run backward with an increase of the combustion oscillations.

In contrast, with this embodiment, because any structural component disturbing the airflow or generating vortexes is not present near the upstream side of the air inlet holes in the burners 11, 111, flames can be suppressed from running backward into the air inlet holes. Also, because of a less number of vortexes being generated, the flow rate of the air distributed to each burner is maintained at the design value, whereby an increase in both the amount of NOx exhausted and the combustion oscillations can be suppressed.

(Eighth Embodiment)

A gas turbine combustor according to an eighth embodiment of the present invention will be described below with reference to FIGS. 16 through 18.

This eighth embodiment concerns a burner manufacturing method. The following description is made of the burner manufacturing method, taking the burner 111, shown in FIG. 3, according to the third embodiment as an example.

Figure 16:
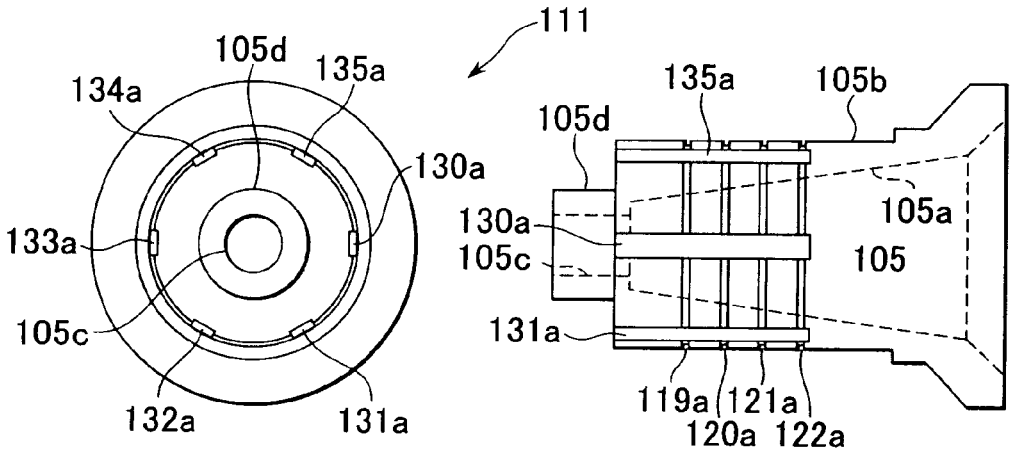
FIG. 16 shows a burner structure in a combustor according to an eighth embodiment of the present invention.

FIG. 16 shows the mixing chamber 105 of the burner 111. Within the mixing chamber 105, the hollow conical wall surface 105*a* is formed so as to spread gradually in the direction of flow. In an outer circumferential wall surface 105*b* of the mixing chamber 105, four small grooves 119*a*, 120*a*, 121*a* and 122*a* each extending in the circumferential direction to provide a circular path are formed at intervals in the axial direction, and large grooves 130*a*, 131*a*, 132*a*, 133*a*, 134*a* and 135*a* extending in the axial direction of the mixing chamber 105 are formed perpendicularly to the small grooves 119*a*, 120*a*, 121*a* and 122*a*.

Further, a nozzle mount hole 105*c* in which the fuel nozzle 113 is to be inserted is formed in an upstream end wall of the mixing chamber 105, and the upstream end wall of the mixing chamber 105 is formed to have an outer circumferential wall surface 105*d* of a smaller diameter than the outer circumferential wall surface 105*b* in the downstream side of the mixing chamber 105. In this embodiment, the large grooves 130*a*, 131*a*, 132*a*, 133*a*, 134*a* and 135*a* formed in the outer circumferential wall surface 105*b* of the mixing chamber 105 have a larger cross-sectional area than that of the small grooves 119*a*, 120*a*, 121*a* and 122*a*.

Figure 17:
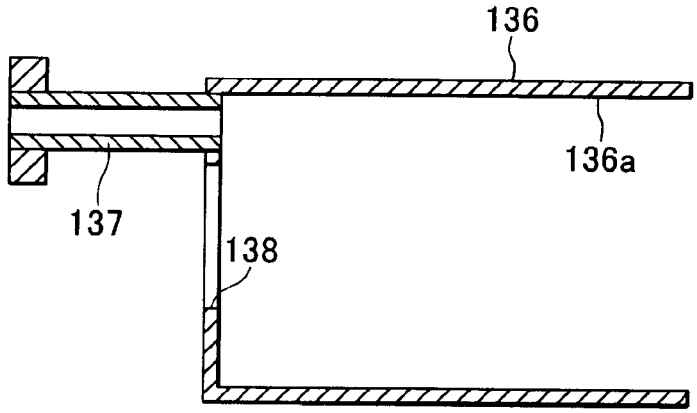
FIG. 17 is a sectional view showing a burner's cover structure in a combustor according to the eighth embodiment of the present invention.

FIG. 17 shows a cover 136 of the mixing chamber 105. The cover 136 is provided at its upstream end (leftward end as viewed in the drawing) with a fuel pipe 137 through which gaseous fuel is supplied to a fuel manifold 112 in the mixing chamber 105. An insertion hole 138 is formed in the cover 136 in match with the outer circumferential wall surface 105*d* of the mixing chamber 105 at the upstream end thereof. Also, the cover 136 has an inner circumferential wall surface 136*a* formed in match with the outer circumferential wall surface 105*b* of the mixing chamber 105 in the downstream side thereof.

Figure 18:
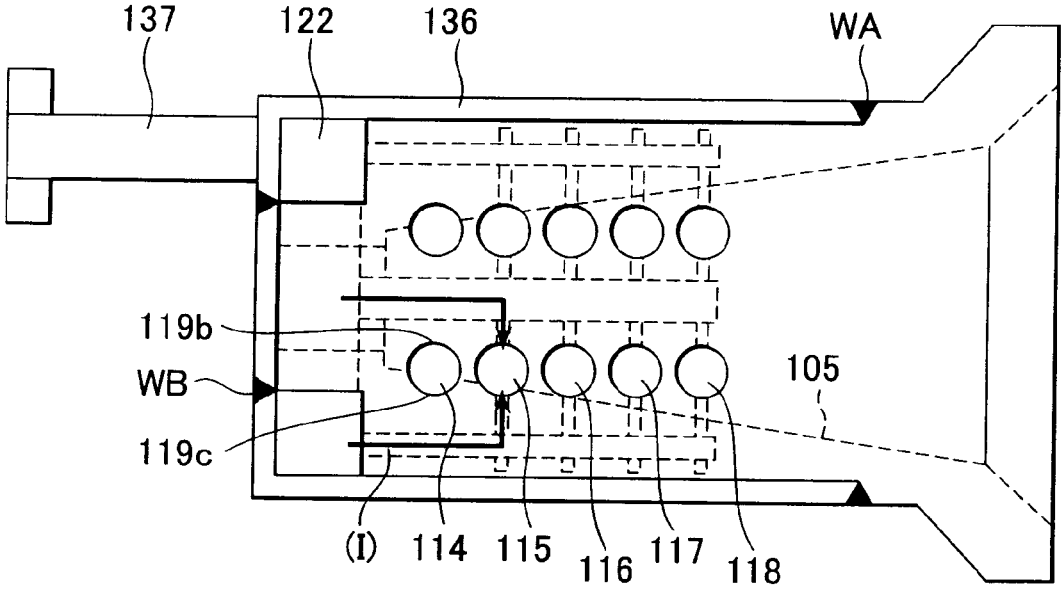
FIG. 18 is a schematic view showing of an assembled burner structure in the combustor according to the eighth embodiment of the present invention.

FIG. 18 shows a state in which the cover 136, shown in FIG. 17, is fitted over the mixing chamber 105, shown in FIG.

16, from the upstream side of the mixing chamber 105. The cover 136 is fixed to the mixing chamber 105 by welding at joining points WA, WB. By fitting the cover 136 over the mixing chamber 105, the fuel manifold 112 is formed upstream of the mixing chamber 105, and the small grooves 119*a*, 120*a*, 121*a* and 122*a* formed in the outer circumferential wall surface 105*b* of the mixing chamber 105 are communicated with the fuel manifold 112 through the large grooves 130*a*, 131*a*, 132*a*, 133*a*, 134*a* and 135*a*.

After welding the cover 136 to the mixing chamber 105, the air inlet holes 114, 115, 116, 117 and 118 are formed so as to locate not only at circumferential intermediate points between adjacent two of the large grooves 130*a*, 131*a*, 132*a*, 133*a*, 134*a* and 135*a* formed in the outer circumferential wall surface 105*b* of the mixing chamber 105, but also on respective axes of the small grooves 119*a*, 120*a*, 121*a* and 122*a*. By forming the air inlet holes to be communicated with the interior of the mixing chamber 105 from an outer surface of the cover 136, respective sections of the small grooves formed in the outer circumferential wall surface 105*b* of the mixing chamber 105 are opened to wall surfaces of the corresponding air inlet holes, whereby the fuel holes 119, 120, 121 and 122, shown in FIG. 7, are formed.

Because of the small grooves 119*a*, 120*a*, 121*a* and 122*a* being communicated with the fuel manifold 112 as described above, when fuel is supplied to the fuel manifold 112 through the fuel pipe 137, the fuel flows to, e.g., one air inlet hole 115 through two fuel holes 119*b*, 119*c*, which are formed to be opened to the air inlet hole 115, as indicated by arrows (J) in FIG. 18. Then, the supplied fuel is mixed into the air for combustion within the air inlet hole 115, thereby providing similar effects to those described above in connection with the third embodiment.

In addition, flows of fuel are caused to collide with each other and to diffuse in the air inlet hole, as shown in FIG. 6(*a*), while the cross-sectional area of the small groove is controlled to regulate the ejection speed of the fuel from each of the fuel holes 119*b*, 119*c*. As a result, a contact area of the fuel with the air for combustion is increased and the mixing of the fuel and the air can be promoted.

As described above, according to one aspect of the present invention, a combustor comprises a mixing-chamber forming member for forming therein a mixing chamber in which air for combustion and fuel are mixed with each other; and a combustion chamber for burning a gas mixture generated by the mixing chamber and producing combustion gases, wherein a channel for supplying the air for combustion to the mixing chamber from the outer peripheral side of the mixing-chamber forming member is provided inside the mixing-chamber forming member. If a structural component such as a channel is mounted to supply the air for combustion to an outer surface of a swirler as in the related art (JP,A 2004-507701), small but relatively strong vortexes are generated downstream of the structural component, thus causing flames to be held in the air inlet holes by the generated vortexes. Also, the vortexes generated by the structural component flow into the swirler without decay, whereby flames are held and backfire is generated. To avoid such a problem, according to this aspect of the present invention, the channel for supplying the air for combustion to the mixing chamber is provided inside the mixing-chamber forming member. This feature eliminates the necessity of providing the channel on the outer side of the mixing-chamber forming member. In other words, according to this aspect of the present invention, because any structural component disturbing the airflow or generating vortexes is not provided on the surface of the swirler, the occurrence of backfire can be suppressed. Further, because any structural component, such as a channel for supplying the air for combustion, is not present on the outer side of the mixing-chamber forming member, i.e., in an inlet area for the air inlet holes, disturbances of the airflow and generation of the vortexes caused by the presence of that structural component can be suppressed. It is hence possible to supply the air at a stable flow rate into the mixing chamber and to improve combustion stability.

According to another aspect of the present invention, a combustor comprises a mixing-chamber forming member for forming therein a mixing chamber in which air for combustion and fuel are mixed with each other; and a combustion chamber for burning a gas mixture mixed in the mixing chamber and producing combustion gases, wherein the mixing-chamber forming member has an outer periphery formed into a substantially cylindrical shape, a channel for supplying the air for combustion to the mixing chamber from the outer peripheral side of the mixing-chamber forming member is provided inside the mixing-chamber forming member, and the channel is provided in a wall surface thereof with a fuel supply portion such that the air for combustion and the fuel are supplied to the mixing chamber through the channel. By forming the outer periphery of the mixing-chamber forming member into a substantially cylindrical shape, in addition to the effects mentioned above, the air for combustion can be suppressed from being disturbed by an outer peripheral surface of the mixing-chamber forming member. It is therefore possible to supply the air at a more stable flow rate into the mixing chamber and to further improve combustion stability. Particularly, in the case using a plurality of burners arranged in a multi-structure, since channels of the air for combustion, which are defined between the burners, are formed by the mixing-chamber forming members each having a substantially cylindrical shape, the air for combustion can be stably supplied to the plurality of burners. Further, by providing the fuel supply portion in the wall surface of the channel such that the air for combustion and the fuel are supplied to the mixing chamber through the channel, the air for combustion and the fuel can be mixed with each other before being supplied to the mixing chamber.

According to still another aspect of the present invention, a combustor comprises a fuel nozzle for supplying fuel; a mixing chamber for mixing the fuel and air therein; a combustion chamber for burning a gas mixture mixed in the mixing chamber; and a mixing-chamber forming member including the mixing chamber formed therein, wherein the mixing-chamber forming member has an outer periphery formed into a substantially cylindrical shape, a plurality of channels for supplying the air for combustion to the mixing chamber from the outer peripheral side of the mixing-chamber forming member are provided inside the mixing-chamber forming member at intervals in the axial direction, and the channel is provided in a wall surface thereof with a fuel supply portion for supplying the fuel to the channel. By providing the plurality of channels for supplying the air for combustion inside the mixing-chamber forming member at intervals in the axial direction, in addition to the effects mentioned above, it is possible to provide a structure in which X/D is changed between the channel positioned in the upstream side of the mixing chamber to supply the air for combustion and the channels positioned in the intermediate and downstream sides of the mixing chamber to supply the air for combustion. As a result, a degree of mixing can be made different in the axial direction of the mixing chamber.

According to still another aspect of the present invention, a combustor comprises a fuel nozzle for supplying fuel; a mixing chamber disposed around and downstream of the fuel nozzle and mixing the fuel and air therein; a combustion chamber disposed downstream of the mixing chamber and burning a gas mixture mixed in the mixing chamber; and a mixing-chamber forming member including the mixing chamber formed therein, wherein the mixing-chamber forming member has an outer periphery formed into a substantially cylindrical shape, a plurality of channels for supplying the air for combustion to the mixing chamber from the outer peripheral side of the mixing-chamber forming member are provided inside the mixing-chamber forming member at intervals in the axial direction, and the channel is provided in a wall surface thereof with a fuel supply portion such that the fuel and the air are premixed in the channel and a premixed gas mixture is supplied to the mixing chamber. By supplying, to the mixing chamber, the premixed gas mixture (primary gas mixture) produced with premixing of the fuel and the air in the channel, in addition to the effects mentioned above, the fuel and the air can be premixed in the channel for supplying the air for combustion before being supplied to the mixing chamber, and the mixing in the mixing chamber can be further promoted. Consequently, unbalance of fuel concentration in the air is eliminated in the premixed gas mixture discharged from the mixing chamber, thus resulting in a premixed gas mixture with the fuel homogeneously mixed therein.

Further, according to the present invention, since the fuel hole is formed to be directly opened to the wall surface of the air inlet hole in the burner, there is no need of separately providing a fuel channel on the outer side of the burner so that the burner has a compact outer surface. Also, since the burner has a cylindrical outer shape and includes no structural component disturbing a stream of the air for combustion which flows around the burner, the air for combustion can be suppressed from peeling away from the outer surface of the burner and from generating separation vortexes. As a result, it is possible to suppress backfire that is caused when the separation vortexes are introduced to the air inlet holes.

Moreover, according to the present invention, since the burner has an outer cylindrical surface, the air for combustion flows more smoothly along the outer surface of the burner than the case where the burner outer surface has any structural component in irregular shape including recesses or projections. Accordingly, it is possible to reduce a pressure loss that is caused upon supply of the air for combustion to the burner, and to increase overall efficiency of a gas turbine.

In addition, according to the present invention, since the mixing chamber is formed into a diffuser-like shape gradually spreading from the upstream side toward the downstream side, the flow speed can be suppressed from being decelerated in the upstream side of the mixing chamber. As a result, the occurrence of backfire can be suppressed.

Thus, the present invention is able to provide the combustor and the combustion method for the combustor, which can suppress backfire and ensure stable combustion.

What is claimed is:

1. A combustor comprising:

a member configured for air for combustion and fuel to be provided together therein; wherein said member has air paths each having an inlet portion configured for the air for combustion to enter the air path therethrough and an outlet portion configured for the air combustion to exit the air path, and fuel supply portions each provided between the inlet portion and the outlet portion in the respectine air paths; and a burner configured to burn air for combustion and fuel exiting the air paths, the burner having a burner axis;

wherein the air paths are provided along the burner axis.

2. The combustor according to claim 1, wherein the opening in each of said air paths is configured to supply the fuel into said air path in a direction skew perpendicular to an axis of the burner.

3. The combustor according to claim 1, wherein the opening in each of said air paths is configured to supply the fuel into said air path in a substantially circumferential direction about an axis of the burner.

4. The combustor according to claim 1, wherein the air paths having linear axes.

5. The combustor according to claim 1, further comprising a plurality of said members and said burners.

6. A combustor comprising:

a member configured for air for combustion and fuel to be provided together therein;

wherein said member has air paths each having an inlet portion configured for the air for combustion to enter the air path therethrough and an outlet portion configured for the air for combustion to exit the air path, and a burner configured to burn air for combustion and fuel exiting the air paths, the burner having a burner axis;

wherein the fuel is supplied through each inner wall surface of the air paths; and wherein the air paths are provided along the burner axis.

7. The combustor according to claim 6, wherein the opening in each of said air paths is configured to supply the fuel into said air path in a direction skew perpendicular to an axis of the burner.

8. The combustor according to claim 6, wherein the opening in each of said air paths is configured to supply the fuel into said air path in a substantially circumferential direction about an axis of the burner.

9. The combustor according to claim 6, wherein the air paths having linear axes.

10. The combustor according to claim 6, further comprising a plurality of said members and said burners.

11. A combustor comprising:

a mixing-chamber forming member configured to form therein a mixing chamber in which air for combustion and fuel are mixed together; and a combustion chamber configured to receive a mixture of air for combustion and fuel from the mixing chamber, and with a burner having a burner axis, burn the mixture and produce combustion gases, wherein the mixing-chamber forming member comprises air paths each haying an inlet portion configured for the air for combustion to enter the air path therethrough and an outlet portion configured for the air for combustion to exit the air path, wherein each of the respective air paths includes an inner wall surface configured with an opening for the fuel to be supplied therethrough into the air path, and wherein the air paths are provided along the burner axis.

12. The combustor according to claim 11, wherein the opening in each of said air paths is configured to supply the fuel into said air path in a direction skew perpendicular to an axis of the burner.

13. The combustor according to claim 11, wherein the opening in each of said air paths is configured to supply the fuel into said air path in a substantially circumferential direction about an axis of the burner.

14. The combustor according to claim 11, wherein the air paths having linear axes.

15. The combustor according to claim 11, further comprising a plurality of said members and said burners.

* * * * *